US008482474B2

(12) United States Patent
Baba et al.

(10) Patent No.: US 8,482,474 B2
(45) Date of Patent: Jul. 9, 2013

(54) ANTENNA APPARATUS

(75) Inventors: Junnei Baba, Fukuoka (JP); Masatoshi Ootsuka, Fukuoka (JP); Tetsuya Ashizuka, Fukuoka (JP)

(73) Assignee: Panasonic Corporation, Osaka (JP)

( * ) Notice: Subject to any disclaimer, the term of this patent is extended or adjusted under 35 U.S.C. 154(b) by 357 days.

(21) Appl. No.: 12/992,058

(22) PCT Filed: May 11, 2009

(86) PCT No.: PCT/JP2009/002048

§ 371 (c)(1),
(2), (4) Date: Feb. 9, 2011

(87) PCT Pub. No.: WO2009/139143

PCT Pub. Date: Nov. 19, 2009

(65) Prior Publication Data

US 2011/0122039 A1 May 26, 2011

(30) Foreign Application Priority Data

May 12, 2008 (JP) ..... P2008-124318
Jun. 20, 2008 (JP) ..... P2008-161338

(51) Int. Cl.
*H01Q 9/28* (2006.01)

(52) U.S. Cl.
USPC ..... 343/795; 343/816; 343/820; 343/821

(58) Field of Classification Search
USPC ..... 343/795, 797, 803, 804, 816, 820, 343/821
See application file for complete search history.

(56) References Cited

U.S. PATENT DOCUMENTS 2,085,226 A * 6/1937 Moser ..... 342/416
2,485,642 A * 10/1949 Newltt ..... 342/434
3,750,185 A 7/1973 Evans
5,523,767 A * 6/1996 McCorkle ..... 343/810

(Continued)

FOREIGN PATENT DOCUMENTS

JP 58-062902 4/1983
JP 2001-352587 12/2001

(Continued)

OTHER PUBLICATIONS

International Search Report dated Aug. 4, 2009.

(Continued)

*Primary Examiner* — Tho G Phan
(74) *Attorney, Agent, or Firm* — Dickinson Wright PLLC

(57) ABSTRACT

An antenna apparatus that can be miniaturized without causing inference caused by antenna currents to be occurred if the high band of a dual band wireless system is close to the band of another wireless system in a wireless communication apparatus incorporating the dual band wireless system and another wireless system is provided. A first switch 5 blocks passage of a signal of a high band (first frequency) and allows passage of a signal of a low band (second frequency). A second switch 6 blocks passage of a signal of the low band (second frequency) and allows passage of a signal of the high band (first frequency). Accordingly, the antenna apparatus operates as a dipole antenna with no antenna current flowing into a feeder line at the first frequency and operates as a monopole antenna wherein a radiation element and a feeder line making up the dipole antenna becomes a radiation element at the second frequency lower than the first frequency.

25 Claims, 25 Drawing Sheets

U.S. PATENT DOCUMENTS

| | | | | |
|---|---|---|---|---|
| 5,532,708 | A * | 7/1996 | Krenz et al. | 343/795 |
| 6,356,242 | B1 * | 3/2002 | Ploussios | 343/795 |
| 6,369,771 | B1 * | 4/2002 | Chiang et al. | 343/795 |
| 7,460,069 | B2 | 12/2008 | Park | |
| 7,855,690 | B2 * | 12/2010 | Hook et al. | 343/754 |
| 2009/0231208 | A1 | 9/2009 | Egawa | |

FOREIGN PATENT DOCUMENTS

| | | |
|---|---|---|
| JP | 2003-209429 | 7/2003 |
| JP | 2005-167821 | 6/2005 |
| JP | 2007-151115 | 6/2007 |
| WO | 2005/122333 | 12/2005 |
| WO | 2006/062060 | 6/2006 |
| WO | 2007/073266 | 6/2007 |

OTHER PUBLICATIONS

European Search Report dated Jun. 23, 2010.

H. Nebiya, et al., "Antenna Design in a Ubiquitous Age," Tokyo Denki University Press, Sep. 2005, pp. 132-135, with English translation.

* cited by examiner

ANTENNA APPARATUS

TECHNICAL FIELD

This invention relates to an antenna apparatus, and in particular to an antenna apparatus used with a dual band wireless system in a wireless communication apparatus incorporating the dual band wireless system and another wireless system.

The invention further relates to an antenna apparatus used with a communication apparatus installing a plurality of wireless devices thereon, and in particular to an antenna apparatus preferably used with a communication apparatus requiring antenna-to-antenna isolation.

BACKGROUND ART

In recent years, the number of wireless communication apparatus that can handle a wireless system of a dual band using two frequency bands of a high band and a low band as typified by a mobile telephone has increased. Among the wireless communication apparatus, to enhance convenience, a wireless communication apparatus incorporating another wireless system such as a wireless LAN also makes its appearance.

As an example, a wireless communication apparatus provided by combining a GSM mobile telephone of a dual band using a 900-MHz band and a 1800-MHz band and a DECT cordless telephone can be pointed out, To use the access line of the DECT cordless telephone as the GSM mobile telephone, it is made possible to use the DECT cordless telephone even in a place where no telephone line exists, and convenience improves.

However, if a wireless system of a dual band and another wireless system are incorporated in one wireless communication apparatus, coupling caused by an antenna current flowing through a board occurs and it becomes impossible to conduct stable communications because of interference depending on the combination.

In the example described above, since the 1800 MHz band of GSM (1710 to 1880 MHz) is adjacent to the DECT band (1880 to 1900 MHz), if a monopole antenna is used as an antenna, interference occurs due to the antenna current flowing into the board and it becomes impossible to conduct stable communications.

If wireless systems having close frequencies are combined, to circumvent interference caused by an antenna current flowing into a board, a dipole antenna where no antenna current flows into the board is effective and hitherto has been used.

Thus, to use a dipole antenna for a dual band antenna of a wireless communication apparatus for making possible the DECT cordless telephone incorporating the GSM mobile telephone as described above, for example, a configuration shown in FIG. 10 is considered in a background art.

FIG. 10 shows a configuration example of a wireless communication apparatus using a background dual band antenna. In FIG. 10, numeral 40 denotes a board. The direction parallel to the board face of the board 40 and orthogonal to left and right side ends is the direction of a horizontal line. This means that the horizontal plane is a plane perpendicular to the board face of the is board 40 and parallel to the top and bottom side ends of the board 40. The direction parallel to the board face of the board 40 and orthogonal to the top and bottom side ends is the direction of a vertical line. This means that the vertical plane is a plane perpendicular to the board face of the board 40 and parallel to the left and right side ends of the board 40.

A wireless circuit of a GSM mobile telephone is placed on the left of the board face of the board 40 and a wireless circuit of a DECT cordless telephone is placed on the right. A ground conductor 39 is provided in the area where they are placed, and necessary connection is made.

The wireless circuit of the GSM mobile telephone includes a dipole antenna 33 of a dual band provided piercing the board face of the board 40 and a GSM module 35 for transmitting and receiving a GSM signal, the dipole antenna and the GSM module connected by a feeder line 34 of a microstrip line. The dipole antenna 33 has a configuration wherein each trap 32 made of a parallel resonant circuit made up of a capacitor and a coil is inserted in a midpoint of a radiation element 31. Putting the dipole antenna into a dual band with traps inserted in a radiation element is a generally adopted technique.

The wireless circuit of the DECT cordless telephone includes a dipole antenna 36 of a single band provided piercing the board face of the board 40 and a DECT module 38 for transmitting and receiving a DECT signal, the dipole antenna and the DECT module connected by a feeder line 37 of a microstrip line.

The dipole antenna 33 and the dipole antenna 36 have the radiation elements placed so that they are inclined 45 degrees with respect to the vertical plane and are orthogonal to each other considering the directivity in the horizontal plane and also considering circumventing of coupling caused by a radiation wave.

It is known that a current flows only into the radiation element in the dipole antenna; while a current paired with a current flowing through a radiation element also flows into a conductor in a monopole antenna. Therefore, according to the configuration shown in FIG. 10, the dipole antenna is used for both the antenna connected to the GSM module and the antenna connected to the DECT module, whereby mutual antenna currents do not flow into the ground conductor and it is made possible to conduct stable communications without causing interference.

Moreover, in recent wireless communications, the case where very close frequency bands are used between different wireless systems has often occurred. Thus, if a highly convenient communication apparatus is configured using two wireless systems in combination, depending on the combination of the wireless systems, they interfere with each other and a problem arises in that the case where stable communications cannot be conducted occurs.

For example, GSM (Global System for Mobile Communications) exists as the standard of a mobile telephone and DECT (Digital Enhanced Cordless Telecommunications) exists as the standard of a cordless telephone. The DECT is a standard for connecting a base unit used in DECT to a public telephone network arriving at each home for use as a cordless telephone. In this case, if the base unit used in DECT is provided with a GSM transmission-reception section for making GSM available and it is made possible to connect the base unit used in DECT to the public telephone network, the cordless telephone can also be used in a place where no telephone line exists or an area where the public telephone network is not built, and convenience for the user is enhanced.

However, DCS1800, one of GSM use bands, is assigned a frequency band of 1710 MHz to 1880 MHz. On the other hand, DECT is assigned a frequency band of 1880 MHz to 1900 MHz. That is, if the DECT base unit is connected to the public telephone network using GSM, since DCS1800 and GSM have adjacent bands, when receiving a signal from a GSM base station, the GSM transmission-reception section of the DECT base unit also receives a transmission signal of the DECT base unit; conversely, when the DECT base unit receives a signal from a DECT cordless handset, the GSM transmission-reception section of the DECT base unit also receives a signal transmitted to a GSM base station, and a problem arises in that it becomes impossible to conduct mutually stable communications.

Therefore, in a communication apparatus provided by combining a plurality of wireless systems using close frequency bands, to circumvent interference of a transmission signal of another wireless system when any desired signal is received, it becomes important to isolate a plurality of antennas in wireless devices. On the other hand, in recent years, it has become hard to sufficiently space installed antennas from each other with miniaturization of a wireless device and thus a new problem also arises in how isolation between the antennas is ensured in a limited space.

As an antenna apparatus adopting a measure to ensure isolation between the antennas in a limited space, for example, an antenna apparatus disclosed in (Patent literature 1) is known. (Patent literature 1) discloses an antenna apparatus wherein two wireless devices housed in the same cabinet use each a monopole antenna, a conductor is placed in the proximity of one antenna, an antenna current of the other antenna is introduced into the conductor, and coupling caused by the antenna current is decreased, whereby isolation between the antennas can be ensured.

CITATION LIST

Patent Literature

Patent literature 1: JP-2005-167821A

Non-patent Literature

Non-patent literature 1: NEBIYA Hideyuki (author) and OGAWA Maki (author): "Antenna Design in A Ubiquitous Age" Tokyo Denki University Press, Sep. 30, 2005 (pp. 133-134)

SUMMARY OF INVENTION

Technical Problem

By the way, in a dipole antenna, symmetry of a current distribution is important to provide good directivity. Therefore, to use a high band antenna as a dipole antenna, to put the dipole antenna into a dual band using traps, it is advisable to connect each trap to both radiation elements for putting the radiation elements together and also use a low band antenna as a dipole antenna of a symmetric structure.

However, miniaturization is demanded for such a wireless communication apparatus, particularly for a wireless communication apparatus often used in a room and if a dual band antenna is used as a dipole antenna, it becomes disadvantageous from the viewpoint of miniaturization because the radiation element length becomes long for the low band.

In view of the circumstances described above, it is an object of the invention to provide an antenna apparatus that can be miniaturized without causing inference caused by antenna currents to be occurred if the high band of a dual band wireless system is close to the band of another wireless system in a wireless communication apparatus incorporating the dual band wireless system and another wireless system.

By the way, as for the directivity of an antenna used with a customer communication apparatus, the case where there is no null point in the horizontal plane is often preferred. For example, in the above-described example in the DECT cordless telephone using GSM for the access line to the public telephone network, the case where there is no null point in the horizontal plane is preferred. The reason is that a DECT base unit can be installed without considering the direction of a GSM base station and a DECT cordless handset can be used while moving around the GSM base station.

However, in the antenna apparatus disclosed in (Patent literature 1) described above, in the antenna to which the conductor is close, there is a possibility that the directivity may be disordered because a null point occurs because of reflection on the conductor, etc. If the conductor is connected to a ground pattern, an electromagnetic wave is also radiated by the current flowing into the conductor via the ground pattern and thus likewise there is a possibility that the directivity may be disordered because a null point occurs because of interference with the essential radiation wave, etc.

In view of the circumstances described above, it is an object of the invention to provide an antenna apparatus which ensures antenna-to-antenna isolation of two wireless devices and can transmit and receive a signal in all directions with no null point in a horizontal plane in a communication apparatus installing two wireless devices using close frequency bands.

Solution to Problem

An antenna apparatus described in the following embodiments includes a dipole antenna including a first radiation element and a second radiation element, each having a quarter wavelength of a first frequency; a high-frequency circuit for conducting communications of a high frequency signal; a ground conductor corresponding to the high-frequency circuit; a signal conductor which connects the dipole antenna to the high-frequency circuit and the ground circuit, the signal conductor having a length where the sum total of the length of the first radiation element and the length of the signal conductor, and the sum total of the length of the second radiation element and the length of the signal conductor become a quarter of a second frequency; a first switch for blocking passage of a signal of the first frequency and allowing passage of a signal of the second frequency; and a second switch for allowing passage of the signal of the first frequency and blocking passage of the signal of the second frequency.

An antenna apparatus described in the following embodiments includes a first dipole antenna; a second dipole antenna; a board formed with a conductor pattern; and first and second feeder lines which connect the conductor pattern on a side of one side-end of the board to feeding points of the first and second dipole antennas, respectively, wherein the feeding points of the first and second dipole antennas are disposed on the same plane in which the board face is outwardly extended from the side of the one side-end of the board, wherein each of a first radiation element joined to the feeding point of the first dipole antenna on one end side on the side of the one end-side of the board, and a second radiation element joined to the feeding point of the second dipole antenna on an opposite end side on the side of the one side-end of the board, are disposed in respective perpendicular planes orthogonal to a board face and the one side-end, and are placed facing each other so that mutual axial directions of the first and second radiation elements are orthogonal to each other, and wherein the axis of the first radiation element is placed so as to be inclined at an angle larger than 0 degrees and smaller than 90 degrees with respect to a line parallel to the board face and orthogonal to the one side-end.

Advantages Effects of Invention

According to the invention, the switch is inserted into the signal conductor for connecting the dipole antenna and the high-frequency circuit, and the antenna apparatus operates as a dipole antenna with no antenna current flowing into the feeder line at the first frequency and operates as a monopole antenna wherein the radiation element and the feeder line making up the dipole antenna becomes the radiation element at the second frequency lower than the first frequency.

Further, according to the invention, the first dipole antenna and the second dipole antenna are placed facing each other as mutual axial directions are orthogonal to each other on the same plane in which the board face is outwardly extended from the side of the one end-side of the board and in the perpendicular plane orthogonal to the board face and the one side-end and are placed so as to be inclined at an angle larger than 0 degrees and smaller than 90degrees with respect to the line parallel to the board face and orthogonal to the one side-end, so that antenna-to-antenna isolation can be ensured, no null point exists in the horizontal plane (plane perpendicular to the board face and parallel to the one side-end), and an electromagnetic wave can be transmitted and received in all directions.

Accordingly, the antenna apparatus can provide the advantage that there can be provided a small-sized antenna apparatus with no inference caused by antenna currents flowing through the ground conductor of the board even in a wireless communication apparatus incorporating a dual band wireless system and another wireless system wherein the high band of the dual band wireless system is close to the frequency of another wireless system.

Accordingly, the antenna apparatus can also provide the advantage that if two wireless systems with close use frequencies are used at the same time, interference between the wireless systems does not occur and it is made possible to conduct stable communications in the wireless systems.

DESCRIPTION OF EMBODIMENTS

Preferred embodiments of antenna apparatuses will be discussed in detail with reference to the accompanying drawings.

(Embodiment 1)

Figure 1:
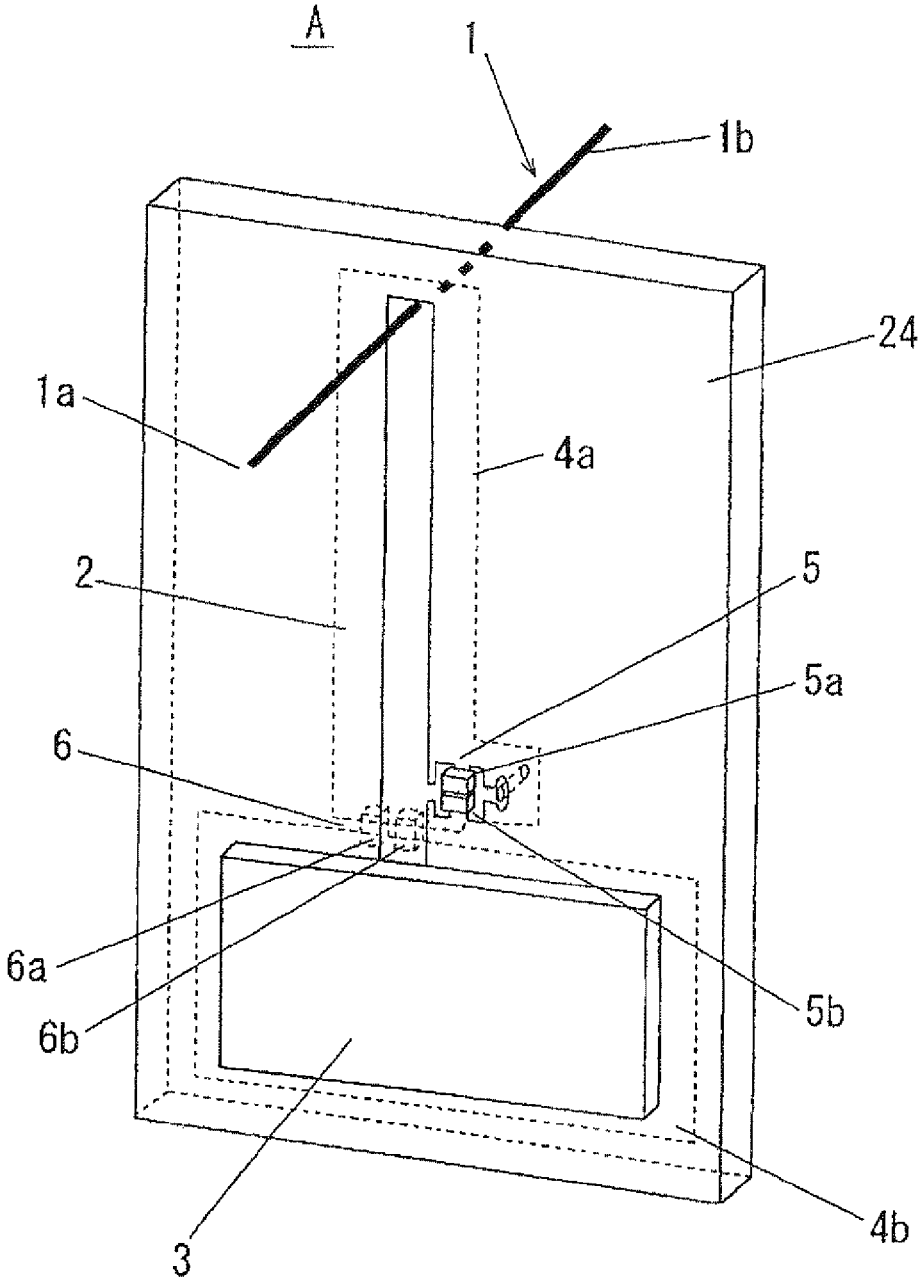
FIG. 1 is a perspective view to show the configuration of an antenna apparatus according to Embodiment 1.

FIG. 1 is a perspective view to show the configuration of an antenna apparatus according to Embodiment 1. In FIG. 1, reference numeral 24 denotes a board. The direction parallel to the board face of the board 24 and orthogonal to left and right side-ends is the direction of a horizontal line. This means that the horizontal plane is a plane perpendicular to the board face of the board 24 and parallel to the top and bottom side-ends of the board 24. The direction parallel to the board face of the board 24 and orthogonal to the top and bottom side-ends is the direction of a vertical line. This means that the vertical plane is a plane perpendicular to the board face of the board 24 and parallel to the left and right side-ends of the board 24.

(Configuration of Antenna Apparatus A)

As shown in FIG. 1, an antenna apparatus A according to Embodiment 1 includes a dipole antenna 1 placed on the side of one end (upper end in FIG. 1) of the board 24, a high-frequency module 3 of a high-frequency circuit placed on an opposite side (lower side in FIG. 1) of the board 24, a feeder line 2 having a microstrip line (signal conductor) for connecting them, and a first switch 5 and a second switch 6 placed on the high-frequency module 3 side of the feeder line 2.

A ground conductor 4*a* is provided on the back of the board 24 corresponding to the area where the feeder line (signal conductor) 2 and the first switch 5 are placed. And a ground conductor 4*b* is provided on the back of the board 24 corresponding to the area where the high-frequency module 3 is placed.

The dipole antenna 1 includes first and second radiation elements 1*a* and 1*b* piercing the surface and the back of the board 24 within the vertical plane and placed symmetrically. Each of the first and second radiation elements 1*a* and 1*b* has a length of λ/4 (where λ is wavelength) of a high-band frequency $f_H$ of a first frequency.

The feeder line (signal conductor) 2 is placed linearly along the vertical line. The upper end of the feeder line (signal conductor) 2 is connected to the first radiation element 1*a* at a feeding point of the dipole antenna 1 and the lower end is connected to the high-frequency module 3.

The ground conductor corresponding to the feeder line (signal conductor) 2 is the ground conductor 4*a*. The upper end of the ground conductor 4*a* is connected to the second radiation element 1*b* at the feeding point of the dipole antenna 1 and the lower end is at a close position so as not to contact the upper end of the ground conductor 4*b*.

Each of the total length of the feeder line (signal conductor) 2 and the first radiation element 1*a* and the total length of the ground conductor (ground conductor 4*a*) corresponding to the feeder line (signal conductor) 2 and the second radiation element 1*b* is a length of λ/4 of a low-band frequency $f_L$ of a second frequency (where $f_H > f_L$).

The first switch 5 includes a chip capacitor 5*a* and a chip coil 5*b* connected in parallel between the feeder line (signal conductor) 2 and the ground conductor (ground conductor 4*a*) corresponding thereto in an end part on the high-frequency module 3 side of the feeder line (signal conductor) 2. The parallel circuit of the chip capacitor 5*a* and the chip coil 5*b* forms a parallel resonant circuit and its resonance frequency is set to the high-band frequency $f_H$.

The second switch 6 includes a chip capacitor 6*a* and a chip coil 6*b* connected in parallel between the lower end of the ground conductor (ground conductor 4*a*) of the feeder line 2 and the upper end of the ground conductor (ground conductor 4*b*) of the high-frequency module 3. The parallel circuit of the chip capacitor 6*a* and the chip coil 6*b* also forms a parallel resonant circuit and its resonance frequency is set to the low-band frequency $f_L$.

(Functions of First Switch 5 and Second Switch 6)

Figure 2A:
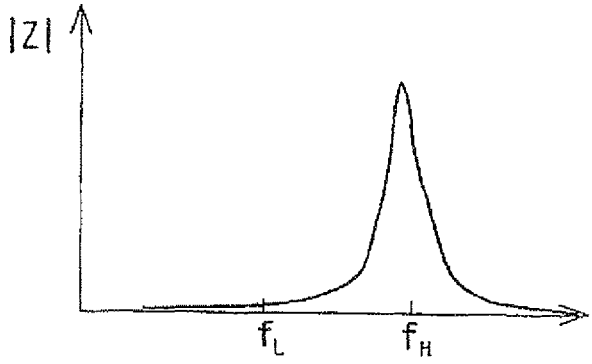
FIGS. 2A and 2B show the frequency characteristic of each parallel resonant circuit in Embodiment 1.
Figure 2B:
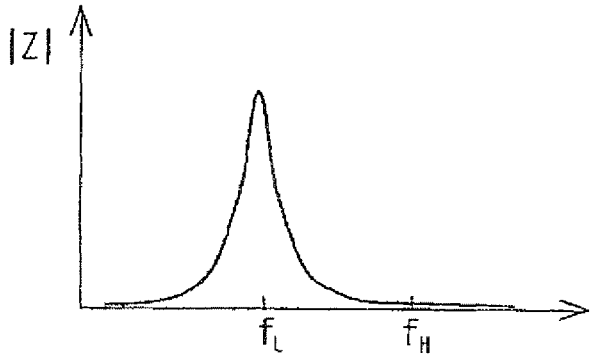

FIGS. 2A and 2B show the frequency characteristic of each parallel resonant circuit. FIG. 2A shows the frequency characteristic when the resonance frequency is the frequency $f_H$ and FIG. 2B shows the frequency characteristic when the resonance frequency is the frequency $f_L$.

Since the parallel resonant circuit forming the first switch 5 has the resonance frequency set to the frequency $f_H$, the frequency characteristic becomes as shown in FIG. 2A. In FIG. 2A, the absolute value of the impedance becomes the maximum at the frequency $f_H$ and becomes the minimum at the frequency $f_L$.

Therefore, the first switch 5 becomes a low-pass filter which is open at the frequency $f_H$ and blocks passage of a signal of a high band (first frequency) and short-circuited at the frequency $f_L$ and allows passage of a signal of a low band (second frequency).

Since the parallel resonant circuit forming the second switch 6 has the resonance frequency set to the frequency $f_L$, the frequency characteristic becomes as shown in FIG. 2B. In FIG. 2B, the absolute value of the impedance becomes the maximum at the frequency $f_L$ and becomes the minimum at the frequency $f_H$.

Therefore, the second switch 6 becomes a high-pass filter which is open at the frequency $f_L$ and blocks passage of a signal of a low band (second frequency) and short-circuited at the frequency $f_H$ and allows passage of a signal of a high band (first frequency).

(Operation of Antenna Apparatus A)

Figure 3A:
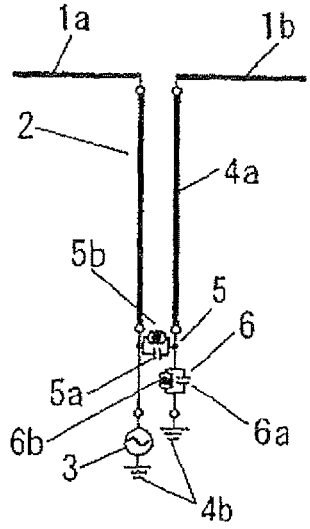
FIGS. 3A to 3C show equivalent circuits of the antenna apparatus in Embodiment 1.
Figure 3B:
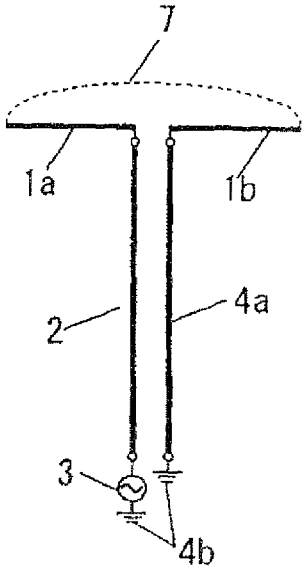
Figure 3C:
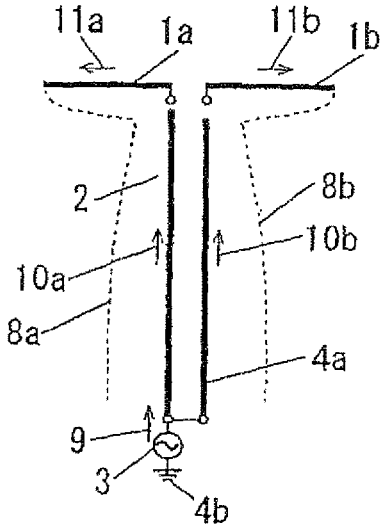
Figure 4:
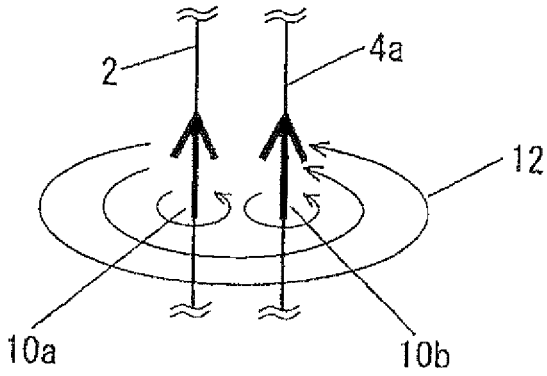
FIG. 4 shows the relationship between a current and a magnetic field flowing into a microstrip line and its corresponding ground conductor.

The operation will be discussed with reference to FIGS. 3A to 3C and 4. FIG. 3A shows an equivalent circuit to the dual band of the antenna apparatus shown in FIG. 1, FIG. 3B shows an equivalent circuit to the high band of the frequency $f_H$, and FIG. 3C shows an equivalent circuit to the low band of the frequency $f_L$. FIG. 4 shows the relationship between a current and a magnetic field flowing into the microstrip line and its corresponding ground conductor.

As shown in FIG. 3A, in the antenna apparatus A, for the dual band, the first switch 5 is provided between the feeder line (signal conductor) 2 and the ground conductor (ground conductor 4*a*) corresponding thereto on the connection side of the feeder line (signal conductor) 2 with the high-frequency module 3, and the second switch 6 is provided between the ground conductor 4*a* and the ground conductor 4*b*.

In the high band of the frequency $f_H$, the first switch 5 becomes open and the second switch 6 becomes short-circuited. Thus, in the antenna apparatus A, for the high band, as shown in FIG. 3B, an exciting current of the high-frequency module 3 is supplied to the first radiation element 1*a* from the feeder line (signal conductor) 2; on the other hand, the second radiation element 1*b* is connected to the ground conductor 4*b* through the ground conductor 4*a*.

Since the length of each of the first and second radiation elements 1*a* and 1*b* is λ/4 of the frequency $f_H$, a current distribution 7 of standing wave becomes the maximum at the center feeding point and becomes zero at both ends of the first and second radiation elements 1*a* and 1*b* as shown in FIG. 3B. Therefore, the dipole antenna 1 operates as a half-wave dipole antenna. This means that the antenna apparatus A operates as an antenna apparatus with the feeder line connected to the dipole antenna 1 for the high band of the frequency $f_H$.

On the other hand, in the low band of the frequency $f_L$, the first switch 5 becomes short-circuited and the second switch 6 becomes open. Thus, in the antenna apparatus A, for the low band, as shown in FIG. 3C, the ground conductor 4*a* to which the second radiation element 1*b* is connected is connected to the high-frequency module 3 together with the feeder line (signal conductor) 2 to which the first radiation element 1*a* is connected. In this case, the length of the feeder line (signal conductor) 2 and the length of the ground conductor (ground conductor 4*a*) corresponding thereto become equal.

In the configuration shown in FIG. 3C, an exciting current 9 of the high-frequency module 3 is distributed to a current 10*a* on the feeder line (signal conductor) 2 side and a current 10*b* on the corresponding ground conductor (ground conductor 4*a*) side in the first switch 5 placed in the short-circuit state. The current 10*a* becomes a current 11 a flowing through the first radiation element 1*a* and the current 10*b* becomes a current 11*b* flowing through the second radiation element 1*b*.

However, the first radiation element 1*a* and the second radiation element 1*b* are in the opposite direction 180 degrees to each other and thus the electromagnetic waves generated by the currents 11*a* and 11*b* cancel each other. This means that an electromagnetic wave is not radiated from the first or second radiation element 1*a* or 1*b*.

Since the current 10*a* and the current 10*b* are in phase, as shown in FIG. 4, magnetic fields 12 produced by the currents cancel each other between the feeder line (signal conductor) 2 and the corresponding ground conductor (ground conductor 4*a*), and strengthen each other outside both the conductors and thus electromagnetic waves are radiated from the feeder line (signal conductor) 2 and the corresponding ground conductor (ground conductor 4*a*), In this case, the electromagnetic waves produced in the feeder line (signal conductor) 2 and the corresponding ground conductor (ground conductor 4*a*) become equal to electromagnetic waves radiated from the monopole antenna.

Each of the total length of the first radiation element 1*a* and the feeder line (signal conductor) 2 and the total length of the second radiation element 1*b* and the ground conductor (ground conductor 4*a*) corresponding to the feeder line (signal conductor) 2 is λ/4 of the low-band frequency $f_L$. Thus, current distributions 8*a* and 8*b* of standing waves produced in both become zero at both ends of the first and second radiation elements 1*a* and 1*b* and become the maximum in lower end parts of the feeder line (signal conductor) 2 and the ground conductor (4*a*) corresponding thereto as shown in FIG. 3C. This means that the whole of the first and second radiation elements 1*a* and 1*b*, the feeder line (signal conductor) 2, and the ground conductor (4*a*) corresponding thereto operates as a monopole antenna. This means that the antenna apparatus A operates as an antenna apparatus having a monopole antenna for transmitting and receiving electromagnetic waves by the currents 10*a* and 10*b* flowing through the feeder line (signal conductor) 2 and the ground conductor (4*a*) corresponding thereto for the low band of the frequency $f_L$.

As described above, according to Embodiment 1, there is provided an antenna apparatus for operating as a dipole antenna for the high band of the frequency $f_H$ and operating as a monopole antenna for the low band of the frequency $f_L$.

As shown in FIG. 3B, in the antenna apparatus A, the currents flowing through the feeder line (signal conductor) 2 and the corresponding ground conductor (ground conductor 4*a*) are in opposite phase in the high band of the frequency $f_H$.

Therefore, if the high band of a dual band wireless system incorporating the antenna apparatus A and the frequency of another contained wireless system are close to each other, coupling caused by the antenna current flowing through the ground conductor can be prevented.

The antenna apparatus A becomes a monopole antenna in the low band wherein the antenna current is not involved in interference, so that the antenna apparatus A can be miniaturized.

Since the first and second switches 5 and 6 are placed on the high-frequency module 3 side of the feeder line (signal conductor) 2 and the corresponding ground conductor (ground conductor 4*a*), a portion becoming a passive element does not exist and interference of a passive element can be eliminated. This measure is effective when the frequency where each of the length of the feeder line (signal conductor) 2 and the length of the corresponding ground conductor (ground conductor 4*a*) becomes λ/4 is largely distant from the frequency $f_L$ of the low band and it is impossible to put into a wide band using a passive element.

As shown in FIG. 1, the feeder line (signal conductor) 2 is placed linearly, so that efficiency of transmission and reception can be enhanced in the monopole antenna operating at the frequency $f_L$ of the low band.

In addition, if the signal conductor of the feeder line is formed of a microstrip line, the ground conductor 4*a* on which the first and second switches 5 and 6 are mounted can be molded integrally with the microstrip line, so that each of the first and second switches 5 and 6 can include an inexpensive chip capacitor and an inexpensive chip coil for cost reduction and mounting of the first and second switches 5 and 6 can be facilitated.

Figure 5:
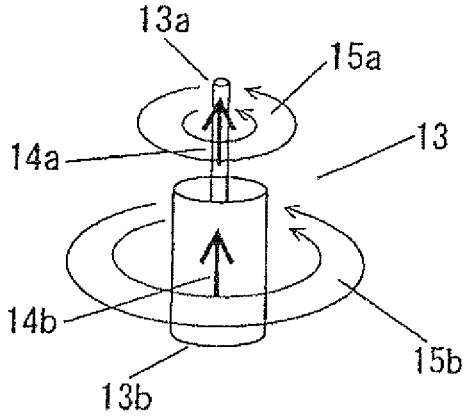
FIG. 5 shows the relationship between a current flowing into a coaxial line and a magnetic field.

In Embodiment 1, the case where a microstrip line is used for the feeder line has been described, but the feeder line can be formed of a coaxial line. FIG. 5 shows the relationship between a current flowing into the coaxial line and a magnetic field.

To use a coaxial cable as the feeder line, as shown in FIG. 5, at the frequency $f_L$ of the low band, a magnetic field 15*a* produced by a current 14*a* flowing into a center conductor 13*a* of a coaxial cable 13 and a magnetic field 15*b* produced by a current 14*b* flowing into an external conductor 13*b* of the coaxial cable spread concentrically, so that directivity equal to that of a monopole antenna having one radiation element and closer to a perfect circle can be provided as the directivity of an electromagnetic wave radiated from the coaxial cable 13.

(Embodiment 2)

Figure 6:
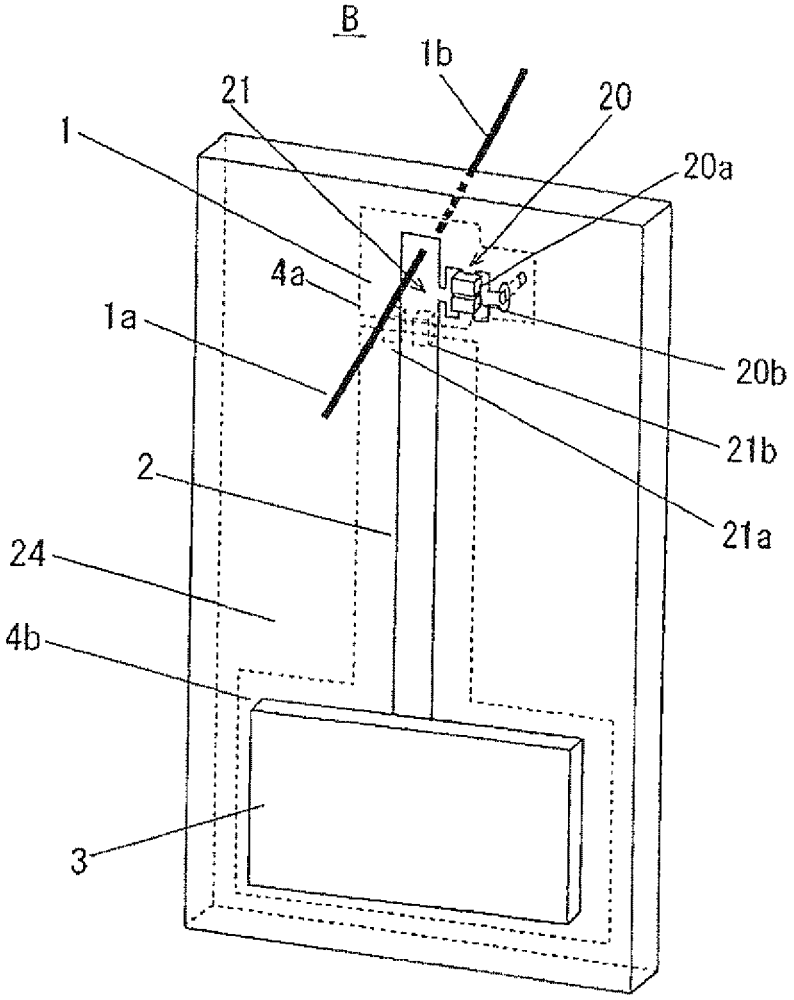
FIG. 6 is a perspective view to show the configuration of an antenna apparatus according to Embodiment 2.

FIG. 6 is a perspective view to show the configuration of an antenna apparatus according to Embodiment 2. Components identical with or equivalent to those shown in FIG. 1 (Embodiment 1) are denoted by the same reference numerals in FIG. 6. The description to follow centers on parts relating to Embodiment 2.

(Characteristic Configuration of Antenna Apparatus B According to Embodiment 2)

As shown in FIG. 6, an antenna apparatus B according to Embodiment 2 has first and second switches 20 and 21 placed on the dipole antenna 1 side in place of the first and second switches 5 and 6 in the configuration shown in FIG. 1 (Embodiment 1).

In accordance with that, ground conductors 4*a* and 4*b* formed on the back of a board 24 are also changed. That is, the ground conductor 4*a* is formed on the periphery of the connection end part of a feeder line (signal conductor) 2 with a dipole antenna I and the ground conductor 4*b* is formed in the area corresponding to the most of the feeder line (signal conductor) 2 and a high-frequency module 3.

The first switch 20 includes a chip capacitor 20*a* and a chip coil 20*b* connected in parallel between the feeder line (signal conductor) 2 and the ground conductor (ground conductor 4*a*) corresponding thereto in the connection end part of the feeder line (signal conductor) 2 with the dipole antenna 1. The parallel circuit of the chip capacitor 20*a* and the chip coil 20*b* forms a parallel resonant circuit and its resonance frequency is set to a high-band frequency $f_H$.

The second switch 21 includes a chip capacitor 6*a* and a chip coil 6*b* connected in parallel between the lower end of the ground conductor (ground conductor 4*a*) of the feeder line 2 and the upper end of the ground conductor (ground conductor 4*b*) of the high-frequency module 3. The parallel circuit of the chip capacitor 6*a* and the chip coil 6*b* also forms a parallel resonant circuit and its resonance frequency is set to a low-band frequency $f_L$.

Since the parallel resonant circuit forming the first switch 20 has the resonance frequency set to the high-band frequency $f_H$, the absolute value of the impedance becomes large at the frequency $f_H$ and becomes small at the frequency $f_L$. Therefore, the first switch 20 becomes a so-called low-pass filter which is open at the frequency $f_H$ and blocks passage of a signal of a high band (first frequency) and short-circuited at the frequency $f_L$ and allows passage of a signal of a low band (second frequency) as well as in Embodiment 1.

Since the parallel resonant circuit forming the second switch 21 has the resonance frequency set to the low-band frequency $f_L$, the absolute value of the impedance becomes large at the frequency $f_L$ and becomes small at the frequency $f_H$. Therefore, the second switch 21 becomes a so-called high-pass filter which is open at the frequency $f_L$ and blocks passage of a signal of a low band (second frequency) and short-circuited at the frequency $f_H$ and allows passage of a signal of a high band (first frequency) as well as in Embodiment 1.

(Operation of Antenna Apparatus B)

Figure 7A:
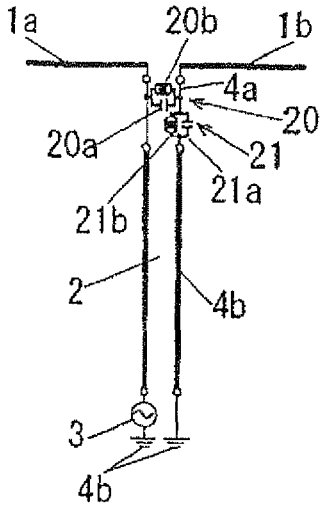
FIGS. 7A to 7C show equivalent circuits of the antenna apparatus in Embodiment 1.
Figure 7B:
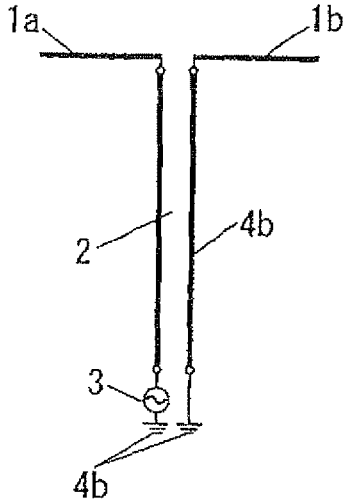
Figure 7C:
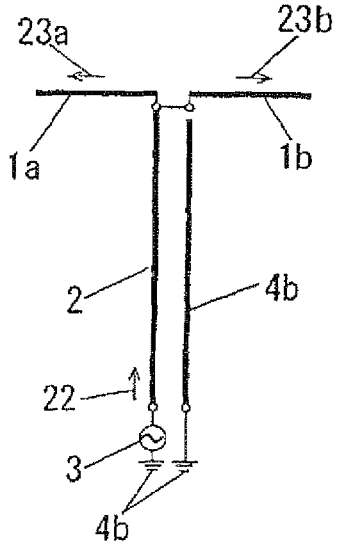

The operation will be discussed with reference to FIGS. 7A to 7C. FIG. 7A shows an equivalent circuit to the dual band of the antenna apparatus shown in FIG. 6, FIG. 7B shows an equivalent circuit to the high band of the frequency $f_H$, and FIG. 7C shows an equivalent circuit to the low band of the frequency $f_L$.

As shown in FIG. 7A, in the antenna apparatus B, for the dual band, the first switch 20 is provided between the feeder line (signal conductor) 2 and the corresponding ground conductor (ground conductor 4*a*) on the connection side of the feeder line (signal conductor) 2 with the dipole antenna 1, and the second switch 21 is provided between the ground conductor 4*a* and the ground conductor 4*b*.

In the high band of the frequency $f_H$, the first switch 20 becomes open and the second switch 21 becomes short-circuited. Thus, in the antenna apparatus B, for the high band, as shown in FIG. 7B, an exciting current of the high-frequency module 3 is supplied to a first radiation element 1*a* from the feeder line (signal conductor) 2; on the other hand, a second radiation element 1*b* is almost connected to the ground conductor 4*b*.

Since the length of each of the first and second radiation elements 1*a* and 1*b* is λ/4 of the frequency $f_H$, the antenna apparatus B operates as an antenna apparatus with the feeder line connected to the dipole antenna 1 for the high-band frequency $f_H$ as described in Embodiment 1.

On the other hand, in the low band of the frequency $f_L$, the first switch 20 becomes short-circuited and the second switch 21 becomes open. Thus, in the antenna apparatus B, for the low band, as shown in FIG. 7C, the second radiation element 1*b* is connected to the first radiation element 1*a* in the proximity of a feeding point and thus the second radiation element 1*b* is connected to the feeder line (signal conductor) 2 and the high-frequency module 3 together with the first radiation element 1*a*. In this case, the length of the feeder line (signal conductor) 2 and the length of the corresponding ground conductor (ground conductor 4*b*) become equal.

In the configuration shown in FIG. 7C, an exciting current 22 of the high-frequency module 3 arrives at the proximity of the feeding point of the dipole antenna 1 through the feeder line (signal conductor) 2 and is distributed to the first radiation element 1*a* side and the second radiation element 1*b* side in the first switch 5 placed in the short-circuit state, so that a current 23*a* flows in the first radiation element 1*a* and a current 23*b* flows in the second radiation element 1*b*.

However, the first radiation element 1*a* and the second radiation element 1*b* are in the opposite direction 180 degrees to each other and thus the electromagnetic waves generated by the currents 23*a* and 23*b* cancel each other. This means that an electromagnetic wave is not radiated from the first or second radiation element 1*a* or 1*b*.

Each of the total length of the first radiation element 1*a* and the feeder line (signal conductor) 2 and the total length of the second radiation element 1*b* and the ground conductor (ground conductor 4*b*) corresponding to the feeder line (signal conductor) 2 is λ/4 of the low-band frequency $f_L$ and thus the antenna operates as a λ/4 monopole antenna.

The ground conductor (4*b*) corresponding to the feeder line (signal conductor) 2 becomes a passive element which resonates at the frequency where the length of the feeder line (signal conductor) 2 becomes λ/4 and is coupled with the monopole antenna including the first and second radiation element 1*a* and 1*b* and the feeder line (signal conductor) 2 for expanding the frequency band to a high frequency band.

Therefore, the antenna apparatus B shown in FIG. 6 can be operated as a monopole antenna where a linearly polarized wave is radiated in the direction of the feeder line (signal conductor) 2.

As described above, according to Embodiment 2, there is provided an antenna apparatus for operating as a dipole antenna for the high band of the frequency $f_H$ and operating as a monopole antenna for the low band of the frequency $f_L$ and being capable of widening the band of the monopole antenna to a high frequency band.

The antenna apparatus B is applied to a dual band wireless system, whereby if the high band of the dual band wireless system is close to the frequency of another contained wireless system, coupling caused by the antenna current flowing through the board can be prevented.

The antenna apparatus B becomes a monopole antenna in the low band wherein the antenna current is not involved in interference, so that it is made possible to miniaturize the antenna apparatus.

The ground conductor from the second switch 21 of the feeder line to the high-frequency module 3 functions as a passive element, so that the frequency characteristic of the monopole antenna operating in a low band can be put into a wide frequency band.

In the antenna apparatus B according to Embodiment 2, a coaxial line can also be used for the feeder line as well as in Embodiment 1.

(Embodiment 3)

Figure 8:
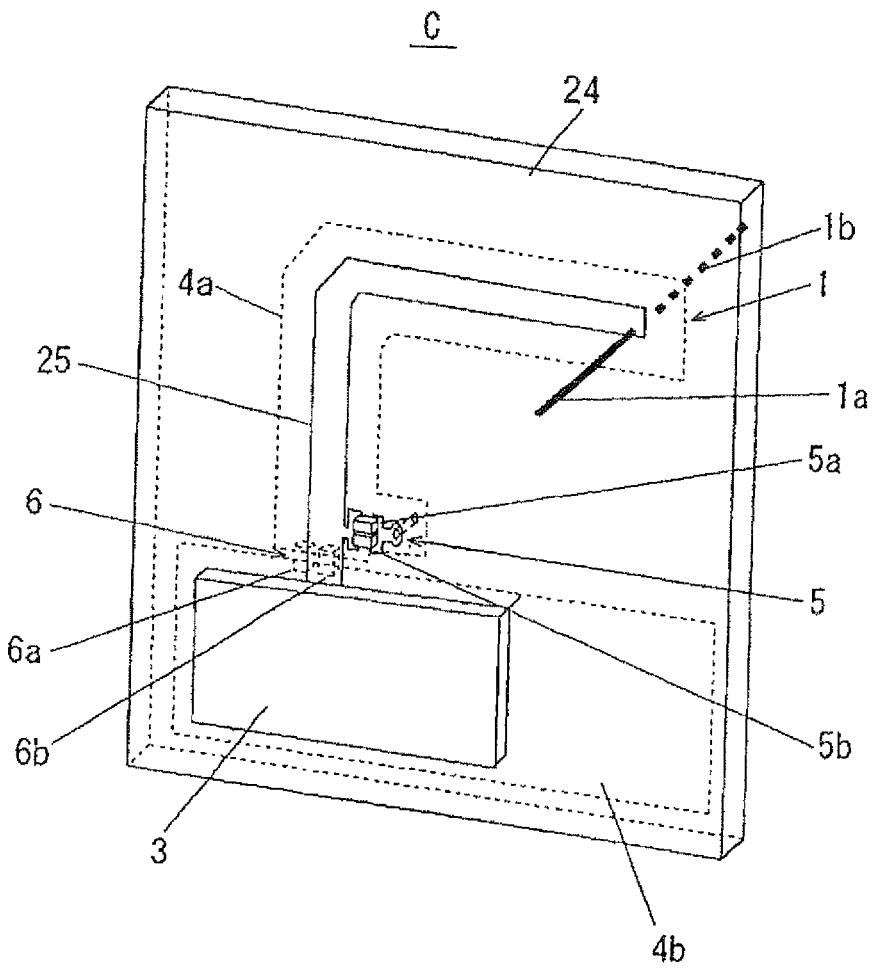
FIG. 8 is a perspective view to show the configuration of an antenna apparatus according to Embodiment 3.

FIG. 8 is a perspective view to show the configuration of an antenna apparatus according to Embodiment 3. Components identical with or equivalent to those shown in FIG. 1 (Embodiment 1) are denoted by the same reference numerals in FIG. 8. The description to follow centers on parts relating to Embodiment 3.

(Characteristic Configuration of Antenna Apparatus C According to Embodiment 3)

As shown in FIG. 8, an antenna apparatus C according to Embodiment 3 is provided with a feeder line 25 bent at the right angle in place of the linear feeder line 2 in the configuration shown in FIG. 1 (Embodiment 1).

According to the configuration, the antenna apparatus operates as an inverted L antenna at a low-band frequency $f_L$, so that it is made possible to decrease the height of the antenna apparatus.

While the application example to Embodiment 1 has been shown, the antenna apparatus of Embodiment 3 can also be applied to Embodiment 2 in a similar manner. The feeder line 25 bent at the right angle may be made of a coaxial line. As a specific example, an application example of the antenna A according to Embodiment 1 is shown below:

(Embodiment 4)

Figure 9:
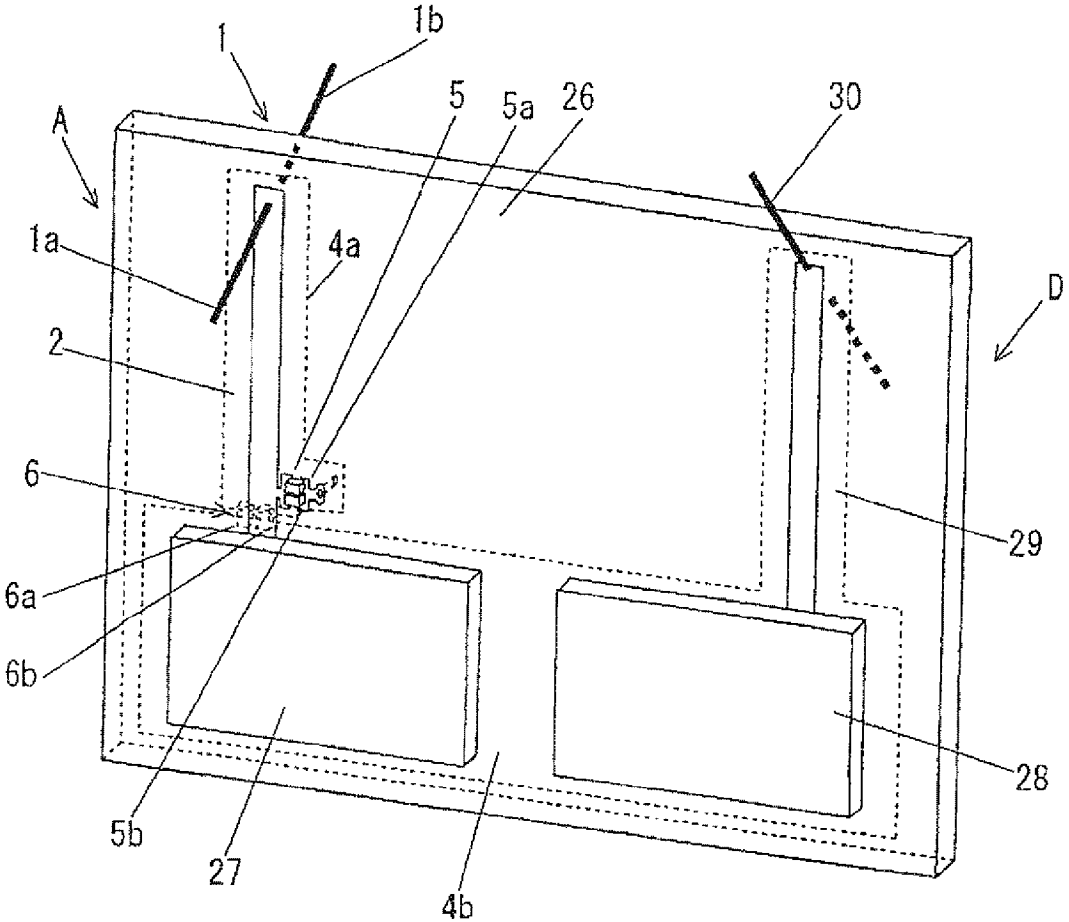
FIG. 9 is a perspective view to show an application example as Embodiment 4, of the antenna apparatus achieved based on Embodiment 1.
Figure 10:
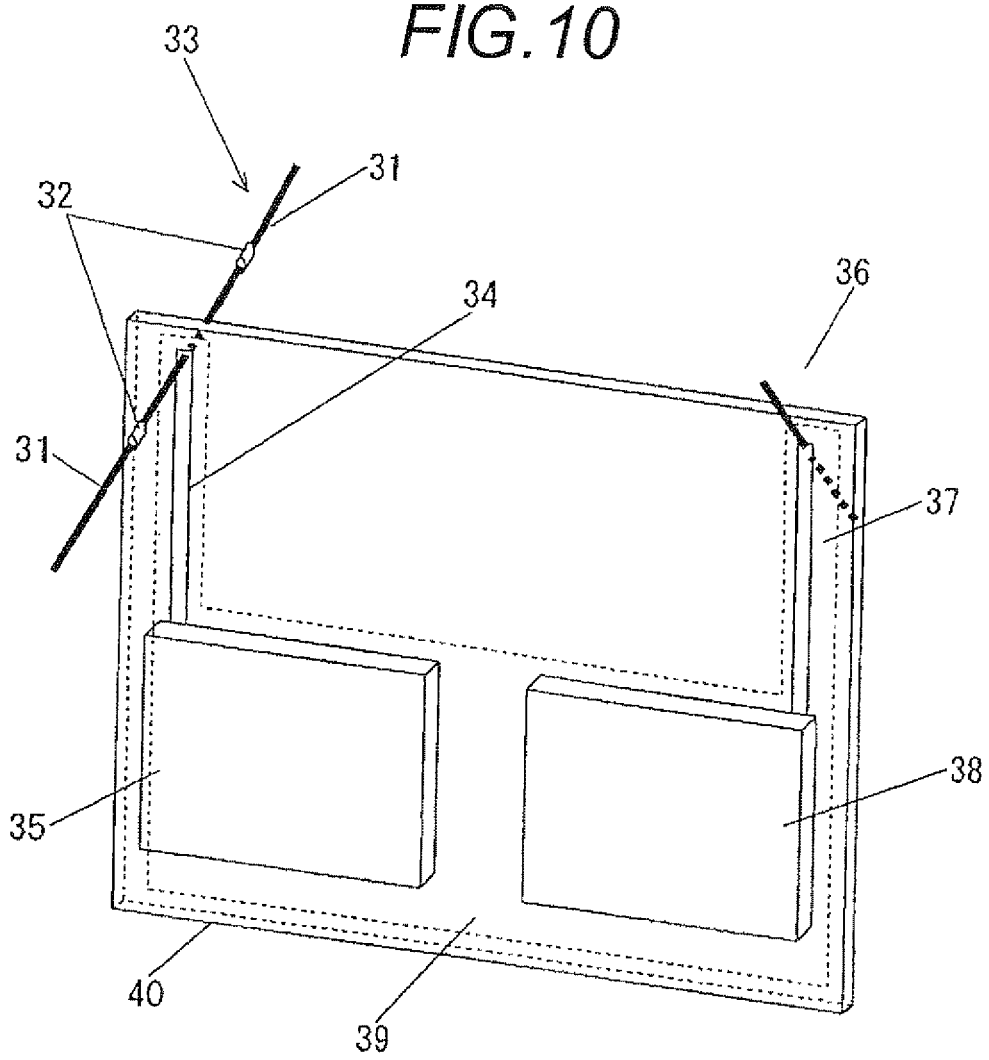
FIG. 10 shows the configuration of a wireless communication apparatus using a background dual band antenna.

FIG. 9 is a perspective view to show an application example of the antenna apparatus according to Embodiment 1 as Embodiment 4. Components identical with or equivalent to those shown in FIG. 1 (Embodiment 1) are denoted by the same reference numerals in FIG. 9. The description relevant to a cabinet is omitted and the description to follow centers on parts relating to Embodiment 4.

(Configuration of Wireless Communication Apparatus having Two Wireless Systems)

In FIG. 9, in addition to the antenna apparatus A according to Embodiment 1, another antenna apparatus D is placed side by side with the antenna apparatus A on a board 26. In the antenna apparatus A, a component 27 provided at the position of the high-frequency module 3 is a GSM module for implementing a dual band wireless system. The GSM module 27 uses a 900-MHz band and a 1800-MHz band (1710 to 1880

MHz) of GSM. A feeder line 2 is connected to an antenna terminal of the GSM module 27.

In another antenna apparatus D, reference numeral 28 denotes a DECT module. The DECT module 28 is another wireless system using a frequency band (1880 to 1900 MHz) close to the high-band frequencies (1800-MHz band) in the GSM module 27. A dipole antenna 30 is connected to an antenna terminal of the DECT module 28 through a feeder line 29.

A dipole antenna 1 and the dipole antenna 30 have mutual radiation elements placed orthogonal to each other in a vertical plane and inclined 45 degrees with respect to the vertical line. This is a measure intended for circumventing a null point coming to a horizontal plane because it is considered that a GSM base station and a DECT cordless handset often come almost to the horizontal plane in an actual use scene.

(Operation of Wireless Communication Apparatus having Two Wireless Systems)

In FIG. 9, when the GSM module 27 uses the 1800-MHz band, the GSM module 27 executes transmission and reception using the dipole antenna 1 including first and second radiation elements 1*a* and 1*b*, and the DECT module 28 executes transmission and reception using the dipole antenna 30. Since both the antennas are dipole antennas, coupling caused by the antenna current flowing through a ground conductor 4*b* does not occurs.

Combined with the radiation elements placed orthogonal to each other, large isolation can be obtained. Further, when the GSM module 27 uses the 900-MHz band, a signal is radiated from a monopole antenna including the feeder line 2 and the first and second radiation elements 1*a* and 1*b*.

Thus, if the antenna apparatus A according to Embodiment 1 is applied, although the antenna connected to the GSM module 27 has a dual band configuration, the length of the radiation element may be matched with the 1800-MHz band of the GSM module 27 and the antenna apparatus can be miniaturized more than that in the related art with traps inserted in each radiation element for providing the dual band.

While the application example of the antenna apparatus A according to Embodiment 1 has been shown in Embodiment 4, the antenna apparatuses B and C according to Embodiments 2 and 3 can also be used in a similar mode.

(Embodiment 5)

Figure 11:
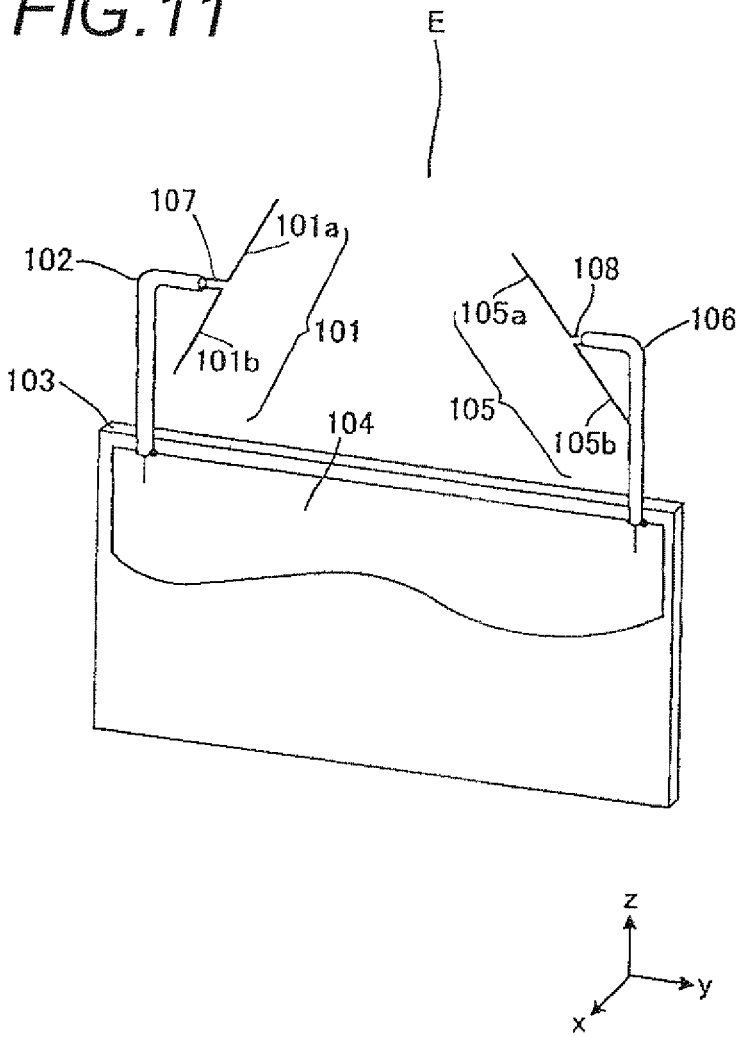
FIG. 11 is a perspective view to show the configuration of an antenna apparatus according to Embodiment 5.

FIG. 11 is a perspective view to show the configuration of an antenna apparatus according to Embodiment 5. In FIG. 11, a lateral direction parallel to the board face of a board 103 is a Y axis, a longitudinal direction parallel to the board face of the board 103 is a Z axis, and a direction perpendicular to the board face of the board 103 is an X axis.

(Configuration of antenna apparatus E according to Embodiment 5)

As shown in FIG. 11, an antenna apparatus E according to Embodiment 5 has a first dipole antenna 101 and a second dipole antenna 105 placed facing each other on the upper end side of the board 103.

The first dipole antenna 101 includes radiation elements 101*a* and 101*b* placed symmetrically with a feeding point 107 therebetween. The feeding point 107 is connected to a wireless circuit (not shown) mounted on the board 103 through a feeder line (coaxial cable) 102 of a support of the first dipole antenna 101. An external conductor of the feeder line 102 is connected to a ground pattern 104 formed on the board 103.

The second dipole antenna 105 includes radiation elements 105*a* and 105*b* placed symmetrically with a feeding point 108 therebetween. The feeding point 108 is connected to the wireless circuit (not shown) mounted on the board 103 through a feeder line (coaxial cable) 106 of a support of the second dipole antenna 105. An external conductor of the feeder line 106 is connected to the ground pattern 104 formed on the board 103.

To support the first and second dipole antennas 101 and 105 only by the feeder lines 102 and 106, a semirigid cable may be used for each of the feeder lines 102 and 106. The feeder lines 102 and 106 are also connected to antenna terminals of the wireless circuit not shown. An external conductor not shown is also connected to the ground pattern 104.

Figure 12A:
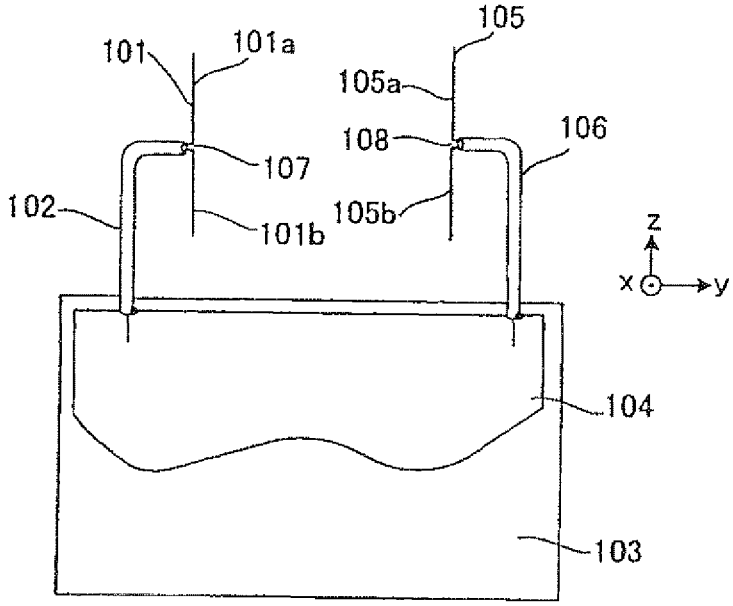
FIGS. 12A and 12B are external views to describe the placement forms of two dipole antennas making up the antenna apparatus shown in FIG. 11.
Figure 12B:
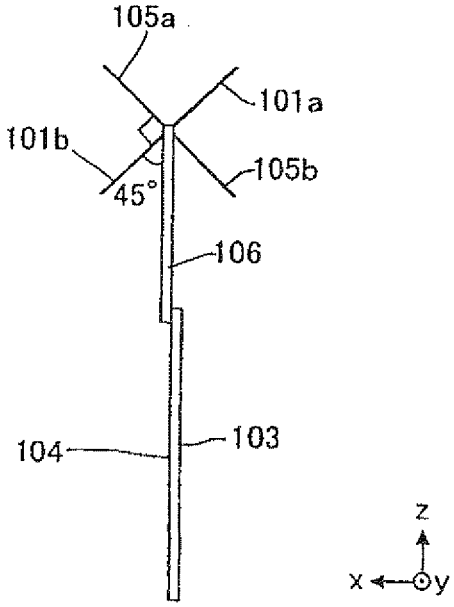

Next, FIGS. 12A and 12B are external views to describe the placement forms of the two dipole antennas making up the antenna apparatus shown in FIG. 11. FIG. 12A is a front view from the X axis direction and FIG. 12B is a side view from the Y axis direction.

As shown in FIG. 12A, the feeder line 102 is formed like an inverted L letter and supports the first dipole antenna 101 on the upper end side of the board 103 such that the feeding point 107 is connected to the horizontal side (Y axis side) tip directed for the second dipole antenna 105 side and the perpendicular side (Z axis side) tip is connected to the ground pattern 104 in a YZ plane parallel to the board face of the board 103.

The feeder line 106 is formed like an inverted L letter and supports the second dipole antenna 105 on the upper end side of the board 103 such that the feeding point 108 is connected to the horizontal side (Y axis side) tip directed for the first dipole antenna 101 side and the perpendicular side (Z axis side) tip is connected to the ground pattern 104 in the YZ plane parallel to the board face of the board 103.

The radiation elements 101*a* and 101*b* of the first dipole antenna 101 are supported orthogonal to the horizontal side (Y axis side) of the feeder line 102 in an XZ plane perpendicular to the board face of the board 103. The radiation elements 105*a* and 105*b* of the second dipole antenna 105 are supported orthogonal to the horizontal side (Y axis side) of the feeder line 106 in the XZ plane perpendicular to the board face of the board 103.

Specifically, as shown in FIG. 12B, the radiation elements 101*a* and 101*b* of the first dipole antenna 101 and the radiation elements 105*a* and 105*b* of the second dipole antenna 105 are placed so as to be orthogonal to each other in the XZ plane. With the first dipole antenna 101 as the reference, the radiation elements 101*a* and 101*b* of the first dipole antenna 101 are placed so that they are inclined at an angle larger than 0 degrees and smaller than 90 degrees from the Z axis direction to the X axis direction in the XZ plane (45 degrees in the example shown in FIG. 12B).

(Directional Characteristics that can be Realized by Antenna Apparatus E According to Embodiment 5)

In-XZ-plane directivity (FIGS. 13A and 13B) and in-XY-plane directivity (FIGS. 14A and 14B) of the two dipole antennas making up the antenna apparatus shown in FIG. 11 will be discussed with reference to FIGS. 13A and 13B and FIGS. 14A and 14B.

Figure 13A:
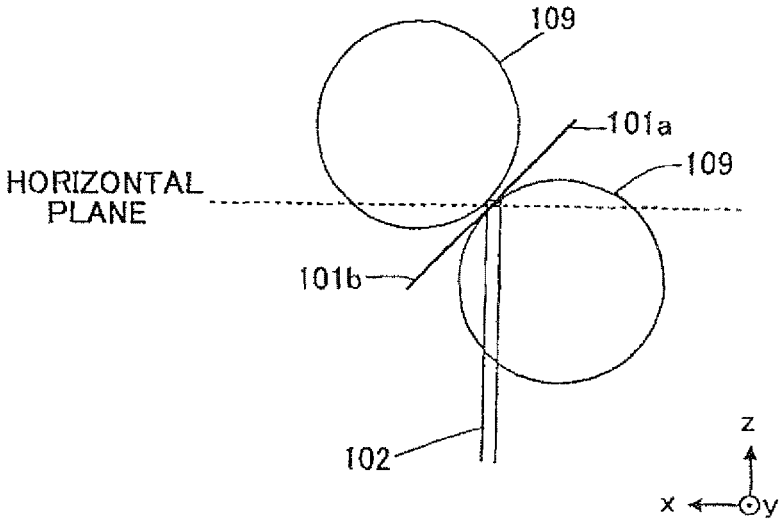
FIGS. 13A and 13B are characteristic drawings to show in-XZ-plane directivity of the two dipole antennas making up the antenna apparatus shown in FIG. 11.
Figure 13B:
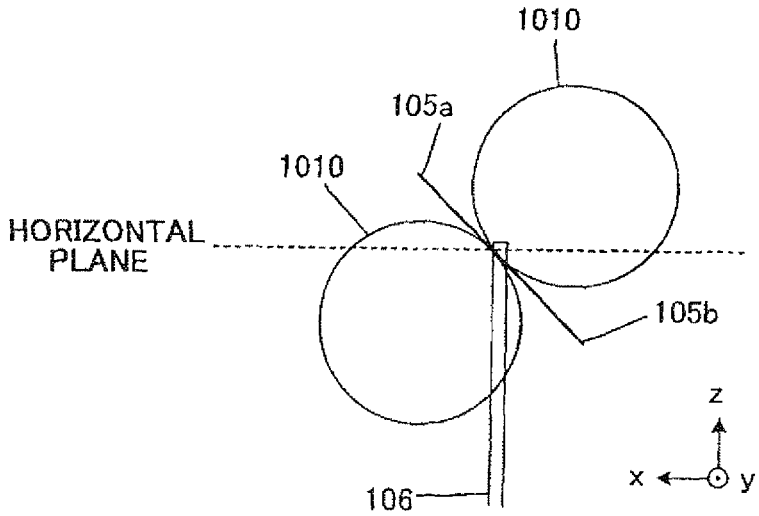

Reference numeral 109 shown in FIG. 13A denotes the in-XZ-plane directivity of the first dipole antenna 101. Reference numeral 1010 shown in FIG. 13B denotes the in-XZ-plane directivity of the second dipole antenna 105. As shown in FIG. 13, the radiation elements 101*a* and 101*b* of the first dipole antenna 101 and the radiation elements 105*a* and 105*b* of the second dipole antenna 105 are inclined 45 degrees with respect to the YZ plane and thus the maximum radiation direction is inclined 45 degrees from the horizontal plane (XY plane) to the Z. axis direction.

Figure 14A:
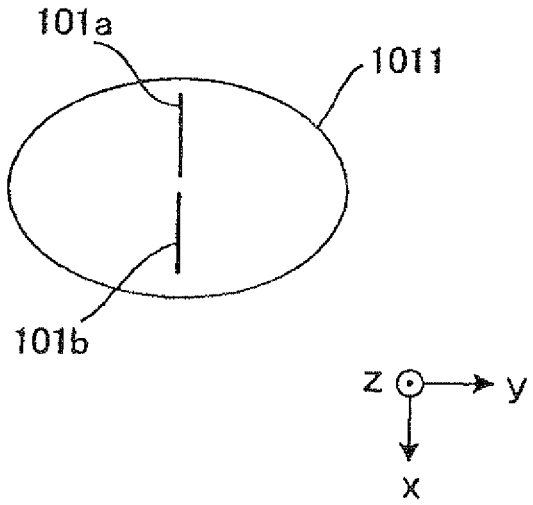
FIGS. 14A and 14B are characteristic drawings to show in-XY-plane directivity of the two dipole antennas making up the antenna apparatus shown in FIG. 11.
Figure 14B:
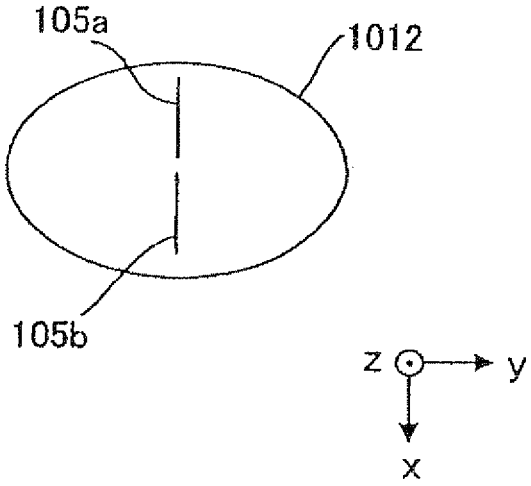

Reference numeral 1011 shown in FIG. 14A denotes the in-XY-plane directivity of the first dipole antenna 101. Reference numeral 1012 shown in FIG. 14B denotes the in-XY-plane directivity of the second dipole antenna 105. As shown in FIG. 14, the in-XY-plane directivity 1011 of the first dipole antenna 101 and the in-XY-plane directivity 1012 of the second dipole antenna 105 become each shaped like an ellipse and directivity for enabling transmission and reception to be executed in all directions in the XY plane with no null point can be provided.

(Advantages Provided in Antenna Apparatus E According to Embodiment 5)

(1) Since the radiation elements 101*a* and 101*b* of the first dipole antenna 101 and the radiation elements 105*a* and 105*b* of the second dipole antenna 105 are placed so as to be orthogonal to each other, polarized waves radiated by the two dipole antennas are also orthogonal to each other. Therefore, although the two dipole antennas are placed closely facing each other, coupling caused by the radiation waves can be decreased and large isolation can be provided.

(2) With one dipole antenna, the axial direction of a radiation element becomes a null point where a radio wave is not transmitted or received; however, the first dipole antenna 101 and the second dipole antenna 105 have the radiation elements placed so as to be orthogonal to each other and they are inclined at the angle larger than 0 degrees and smaller than 90 degrees from the Z axis direction to the X axis direction (45 degrees in the example shown in FIG. 12), so that no null point exists in the XY plane (horizontal plane), the two dipole antennas can provide well balanced directivity, and a radio wave can be transmitted and received in all directions.

(3) Since the feeding points 107 and 108 are provided on the extension of the conductor pattern formed on the board 103, blocking transmission and reception waves by the ground pattern 104 formed on the board 103 or mounted components not shown is eliminated and a radio wave can be transmitted and received efficiently.

(4) Since the radiation elements 101*a* and 101*b* of the first dipole antenna 101 and the radiation elements 105*a* and 105*b* of the second dipole antenna 105 are placed at a distance from the conductor patterns of the ground pattern 104 formed on the board 103, etc., the electromagnetic fields in the proximity of the radiation elements 101*a* and 101*b* and in the proximity of the radiation elements 105*a* and 105*b* according to the conductor patterns are not disordered and the directivity of the two dipole antennas is kept. Accordingly, an unnecessary gain decrease does not occur in the in-XY-plane (horizontal plane) directivity.

(5) The first and second dipole antennas 101 and 105 of balanced antennas are used as the two antennas, so that coupling caused by the antenna current flowing into the ground pattern 104 formed on the board 103, observed when an unbalanced antenna of a monopole antenna, etc., is used can be suppressed and larger isolation can be provided.

(6) The feeder line 102 is orthogonal to the radiation elements 101*a* and 101*b* in the proximity of the feeding point 107 and the feeder line 106 is orthogonal to the radiation elements 105*a* and 105*b* in the proximity of the feeding point 108, so that symmetry of electromagnetic fields in the proximity of the radiation elements is kept and disorder of directivity caused by the feeder line can be suppressed.

(Embodiment 6)

Figure 15:
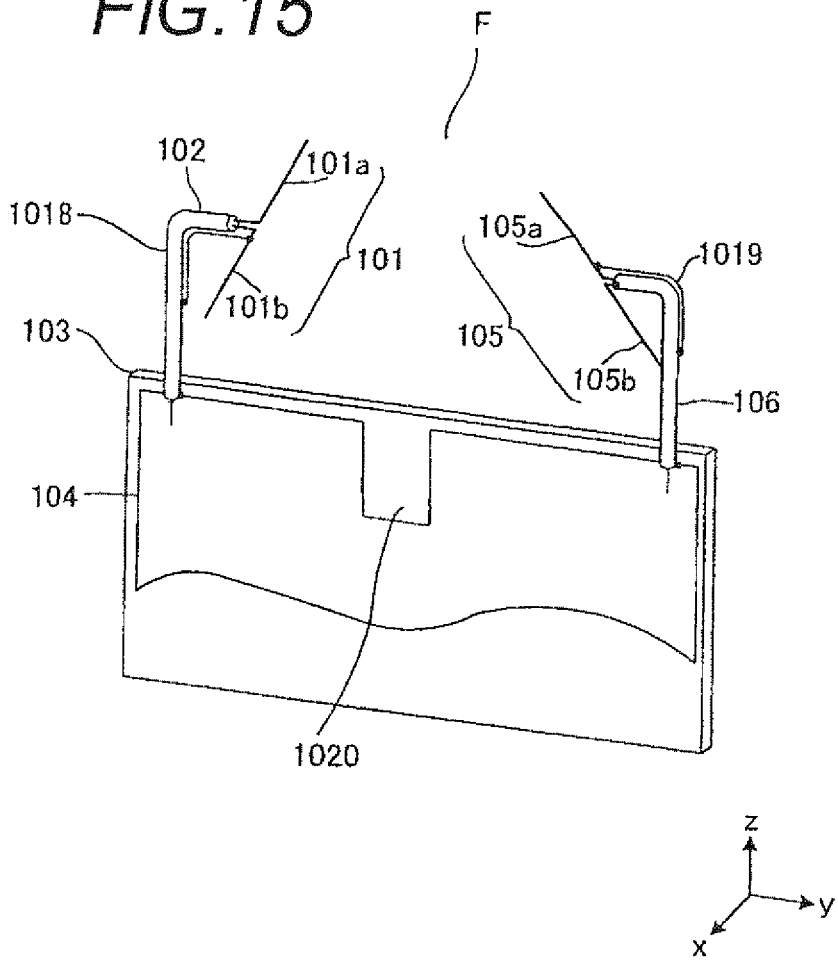
FIG. 15 is a perspective view to show the configuration of an antenna apparatus according to Embodiment 6.

FIG. 15 is a perspective view to show the configuration of an antenna apparatus according to Embodiment 6. Components identical with or equivalent to those shown in FIG. 11 (Embodiment 5) are denoted by the same reference numerals in FIG. 15. The description to follow centers on parts relating to Embodiment 6.

(Characteristic Configuration in Antenna Apparatus F According to Embodiment 6)

As shown in FIG. 15, an antenna apparatus F according to Embodiment 6 has a first dipole antenna 101 provided with a branch conductor 1018 and likewise has a second dipole antenna 105 provided with a branch conductor 1019 and further is provided with a notch 1020 with a part of a ground pattern 104 deleted on the upper end side of the ground pattern 104 formed on a board 103 in the configuration shown in FIG. 11 (Embodiment 5).

The branch conductor 1018 is a conductor line forming a balanced-unbalanced transformer and has a length of λ/4 of the use frequency of the first dipole antenna 101. One end of the branch conductor 1018 is connected to a radiation element 101*b* connected to a center conductor of a coaxial cable 102 of a feeder line of the first dipole antenna 101. The branch conductor 1018 is placed along the coaxial cable 102 and is connected at an opposite end to an external conductor of the coaxial cable 102.

The branch conductor 1019 is a conductor line forming a balanced-unbalanced transformer and has a length of λ/4 of the use frequency of the second dipole antenna 105. One end of the branch conductor 1019 is connected to a radiation element 105*b* connected to a center conductor of a coaxial cable 106 of a feeder line of the second dipole antenna 105. The branch conductor 1019 is placed along the coaxial cable 106 and is connected at an opposite end to an external conductor of the coaxial cable 106.

The notch 1020 is provided at a position where the elevation angle viewing the first dipole antenna 101 becomes equal to the elevation angle viewing the second dipole antenna 105. Coupling caused by a radiation wave between the two dipole antennas is received directly at the other antenna and in addition, also occurs because of a reflected wave based on a conductor pattern provided on the board 103. This means that the upper end side of the ground pattern 104 formed on the board 103 becomes a reflected wave path connecting the first dipole antenna 101 and the second dipole antenna 105. To cut off the reflected wave path, the notch 1020 is provided at the midpoint between the first dipole antenna 101 and the second dipole antenna 105.

(Advantages According to Characteristic Configuration in Antenna Apparatus F According to Embodiment 6)

(1) The radiation elements 101*a* and 101*b* of the first dipole antenna 101 and the radiation elements 105*a* and 105*b* of the second dipole antenna 105 are made orthogonal to each other, so that coupling caused by the radiation waves is suppressed. However, if power is fed into the dipole antenna of a kind of balanced circuit on an unbalanced line, a part of the fed current propagates on the external conductor of the feeder line and flows into the ground pattern 104 formed on the board 103. When the current arrives at the other dipole antenna, coupling occurs between the two dipole antennas. In contrast, the balanced-unbalanced transformer is added, whereby the current not flowing into the radiation element 101*a* and flowing into the external conductor of the coaxial cable 102 and the current not flowing into the radiation element 101*b* and flowing through the external conductor of the coaxial cable 106 can be suppressed. That is, coupling in the antenna current flowing through the ground pattern 104 can be decreased and thus isolation can be further increased.

(2) Since the notch 1020 is provided on the upper end side of the ground pattern 104 which becomes a path of coupling caused by a reflected wave, the reflected wave does not reach the other antenna and coupling caused by the reflected wave can also be suppressed.

As described above, according to Embodiment 6, coupling via the ground pattern 104 and coupling caused by the reflected wave on the upper end side of the ground pattern 104 can be suppressed, so that it is made possible to further enhance isolation between the two antennas.

In Embodiments 5 and 6, a coaxial cable is used as the feeder line, but a printed line such as a microstrip line or a triplate line may be used. In this case, the coaxial cable becomes unnecessary and working of connecting the coaxial cable to the board also becomes unnecessary, so that cost reduction of the antenna apparatus can be accomplished.

The radiation element may be not only linear as shown in Embodiments 5 and 6, but also shaped like a meander to shorten the element length. It may be not only formed of a conductor rod as shown in Embodiments 5 and 6, but also formed as a pattern on the board 103.

In short, according to Embodiments 5 and 6, the first dipole antenna 101 and the second dipole antenna 105 are placed facing each other as mutual axial directions are orthogonal to each other on the same plane in which the board face (XY plane) is outwardly extended from the side-end on the upper side of the Z axis of the board 103 and in the perpendicular plane (XZ plane) is orthogonal to the board face (XY plane) and the upper side-end (Y axis) and are placed so as to be inclined at an angle larger than 0 degrees and smaller than 90 degrees with respect to the line (Z axis) parallel to the board face and orthogonal to the upper side-end (for example, 45 degrees), so that antenna-to-antenna isolation can be ensured, no null point exists in the horizontal plane (plane perpendicular to the board face and parallel to the upper side-end, namely, XY plane), and an electromagnetic wave can be transmitted and received in all directions.

Accordingly, if two wireless systems whose use frequencies are close are used at the same time, interference between the wireless systems does not occur and it is made possible to conduct stable communications in each of the wireless systems. As a specific example, an application example of the antenna E according to Embodiment 5 is shown below:

(Embodiment 7)

Figure 16:
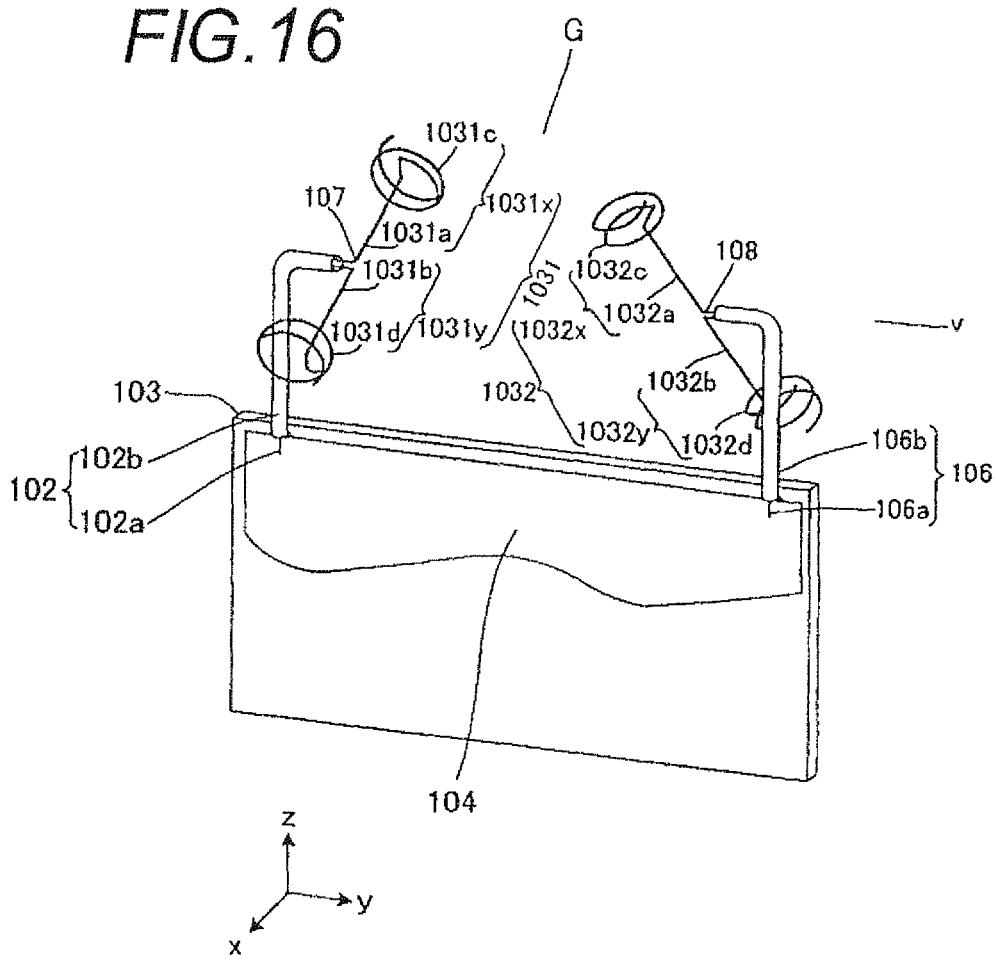
FIG. 16 is a perspective view to show the configuration of an antenna apparatus according to Embodiment 7.

FIG. 16 is a perspective view to show the configuration of an antenna apparatus according to Embodiment 7. Components identical with or equivalent to those shown in FIG. 11 (Embodiment 5) are denoted by the same reference numerals in FIG. 16. The description to follow centers on parts relating to Embodiment 7.

(Configuration of Antenna Apparatus According to Embodiment 7)

As shown in FIG. 16, an antenna apparatus G according to Embodiment 7 is provided with first and second dipole antennas 1031 and 1032 in place of the first and second dipole antennas 101 and 105 in the configuration shown in FIG. 11 (Embodiment 5). In the description to follow, the first and second dipole antennas 1031 and 1032 are simply referred to as first and second antennas 1031 and 1032.

In FIG. 16, the first antenna 1031 includes linear parts 1031*a* and 1031*b* each at one point connected to a feeding point 107 and helical parts 1031*c* and 1031*d* formed at opposite ends of the linear parts 1031*a* and 1031*b* away from the feeding point 107. Likewise, the second antenna 1032 includes linear parts 1032*a* and 1032*b* each at one point connected to a feeding point 108 and helical parts 1032*c* and 1032*d* formed at opposite ends of the linear parts 1032*a* and 1032*b* away from the feeding point 108.

Each of feeder lines 102 and 106 is formed of a coaxial cable as mentioned above. In Embodiment 7, center conductors of the feeder lines 102 and 106 are called Hot side conductor feed lines 102*a* and 106*a*, and external conductors of the feeder lines 102 and 106 are called Cold side conductor feed lines 102*b* and 106*b*.

In the example shown in FIG. 16, one end of the linear part 1031*a* of the first antenna 1031 is connected to the Hot side conductor feed line 102*a* of the feeder line 102, and one end of the linear part 1031*b* is connected to the Cold side conductor feed line 102*b* of the feeder line 102. Therefore, in the first antenna 1031, the linear part 1031*a* and the helical part 1031*c* become a plus side radiation element 1031*x*, and the linear part 1031*b* and the helical part 1031*d* become a minus side radiation element 1031*y*.

In the example shown in FIG. 16, one end of the linear part 1032*a* of the second antenna 1032 is connected to the Hot side conductor feed line 106*a* of the feeder line 106, and one end of the linear part 1032*b* is connected to the Cold side conductor feed line 106*b* of the feeder line 106. Therefore, in the second antenna 1032, the linear part 1032*a* and the helical part 1032*c* become a plus side radiation element 1032*x*, and the linear part 1032*b* and the helical part 1032*d* become a minus side radiation element 1032*y*.

The helical directions of the helical parts 1031*c* and 1031*d* in the first antenna 1031 are formed so as to become directions in which energy for the helical parts 1031*c* and 1031*d* to receive a transmission wave from the second antenna 1032 and energy for the linear parts 1031*a* and 1031*b* to receive the transmission wave cancel each other.

The helical directions of the helical parts 1032*c* and 1032*d* in the second antenna 1032 are formed so as to become directions in which energy for the helical parts 1032*c* and 1032*d* to receive a reflected wave produced as a transmission wave from the first antenna 1031 is reflected on another component existing in the vicinity of a midpoint on the path to the second antenna 1032 and energy for the linear parts 1032*a* and 1032*b* to receive the reflected wave cancel each other.

In the example shown in FIG. 16, the helical directions of the helical parts 1031*c* and 1031*d* in the first antenna 1031 are a dextral (clockwise) direction viewed from the feeding point 107, and likewise the helical directions of the helical parts 1032*c* and 1032*d* in the second antenna 1032 are a dextral (clockwise) direction viewed from the feeding point 108.

Figure 17:
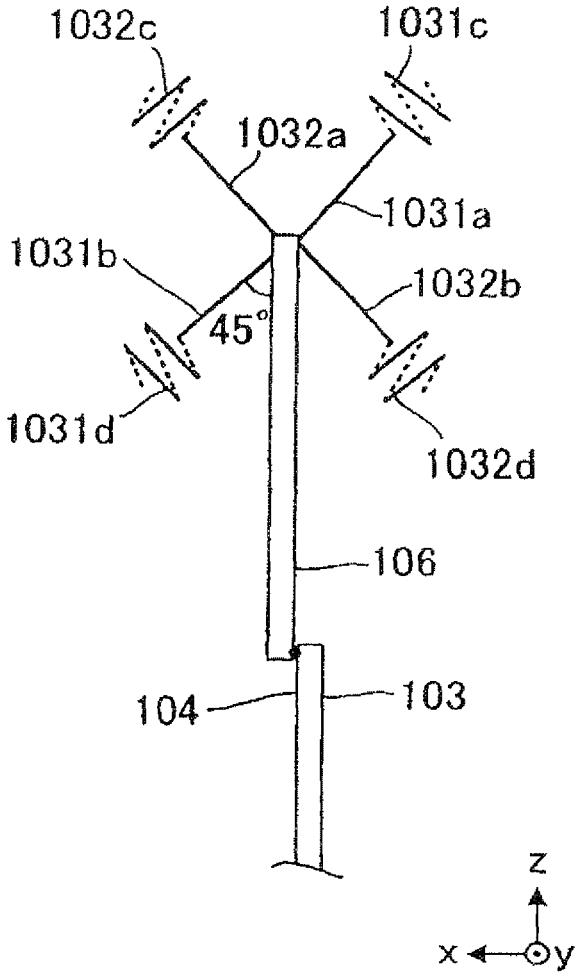
FIG. 17 is an external view to describe the placement form of two dipole antennas making up the antenna apparatus shown in FIG. 16.

Next, FIG. 17 is an external view to describe the placement form of the two dipole antennas making up the antenna apparatus shown in FIG. 16. FIG. 17 shows the placement form viewed from the feeding point 108 to the feeding point 107 from a V direction in the Y axis direction parallel to the board face of a board 103 in FIG. 16.

In FIG. 17, the linear parts 1031*a* and 1031*b* of the first antenna 1031 and the linear parts 1032*a* and 1032*b* of the second antenna 1032 are placed so as to be orthogonal to each other and are inclined 45 degrees with respect to the board face of the board 103. In the example shown in FIG. 16, the helical part 1031*d* in the minus side radiation element 1031*y* of the first antenna 1031 and the helical part 1032*d* in the minus side radiation element 1032*y* of the second antenna 1032 are placed at positions close to the board 103 side as shown in FIG. 17. The helical part 1031*c* in the plus side radiation element 1031*x* of the first antenna 1031 and the helical part 1032*c* in the plus side radiation element 1032*x* of the second antenna 1032 are placed at positions distant from the board 103 side.

The solid line portions shown in the helical parts 1031*c* and 1031*d* of the first antenna 1031 are portions that have extremely small crossing angles with the linear parts 1031*a* and 1031*b* and can be assumed to be almost orthogonal, and dashed line portions are portions where the crossing angles with the linear parts 1031*a* and 1031*b* are large. Likewise, the solid line portions shown in the helical parts 1032*c* and 1032*d* of the second antenna 1032 are portions that have extremely small crossing angles with the linear parts 1032*a* and 1032*b* and can be assumed to be almost orthogonal, and dashed line portions are portions where the crossing angles with the linear parts 1032*a* and 1032*b* are large.

Thus, the solid line portions of the helical parts 1031*c* and 1031*d* of the first antenna 1031 are opposed to the linear parts 1032*a* and 1032*b* of the second antenna 1032, and the dashed line portions of the helical parts 1031*c* and 1031*d* are not opposed to the linear parts 1032*a* and 1032*b* of the second antenna 1032. Likewise, the solid line portions of the helical parts 1032*c* and 1032*d* of the second antenna 1032 are opposed to the linear parts 1031*a* and 1031*b* of the first antenna 1031, and the dashed line portions of the helical parts 1032*c* and 1032*d* are not opposed to the linear parts 1031*a* and 1031*b* of the first antenna 1031.

(Isolation Between First Antenna 1031 and Second Antenna 1032)

The first antenna 1031 has the helical parts 1031*c* and 1031*d* and the second antenna 1032 has the helical parts 1032*c* and 1032*d*; the helical directions are determined as mentioned above, whereby the first antenna 1031 and the second antenna 1032 can adjust the reception sensitivity of a transmission wave from the other antenna and consequently the isolation therebetween can be optimized.

Since the transmission frequency from the first antenna 1031 and the transmission frequency from the second antenna 1032 are close to each other, in each of the first antenna 1031 and the second antenna 1032, the effect of the transmission wave from the other (direct wave and reflected wave) must be suppressed as much as possible.

In this regard, the linear parts 1031*a* and 1031*b* of the first antenna 1031 and the linear parts 1032*a* and 1032*b* of the second antenna 1032 are orthogonal to each other and thus the linear parts of one antenna hardly receive and reflect the transmission wave from the other (direct wave, reflected wave) and almost no antenna current flows.

In contrast, in the helical parts of one antenna, mainly on the side opposed to the other antenna (in the solid line portions of the helical parts 1031*c* and 1031*d* of the first antenna 1031, the solid line portions of the helical parts 1032*c* and 1032*d* of the second antenna 1032), the transmission wave from the other (direct wave, reflected wave) is received and reflected and thus an antenna current flows.

Therefore, in the first antenna 1031 and the second antenna 1032, the following two measures are taken in the helical part of each antenna:

(1) In the first antenna 1031 and the second antenna 1032, the maximum diameter of the helical parts of one antenna becomes shorter than the length of the linear parts of the other. Accordingly, if the helical parts of one antenna receive the transmission wave from the other (direct wave, reflected wave), the reception region is small and thus the effect of the transmission wave from the other (direct wave, reflected wave) can be lessened.

(2) In the first antenna 1031 and the second antenna 1032, the length resulting from linearly expanding the helical parts of each antenna becomes shorter than the length of the linear parts of the antenna. Accordingly, if the helical parts of one antenna receive the transmission wave from the other (direct wave, reflected wave), the reception region is small and thus the energy of the flowing antenna current is small. Therefore, the effect of the transmission wave of one antenna (direct wave, reflected wave) on the directivity of the other antenna can be suppressed.

(Effect of Direct Wave)

Figure 18A:
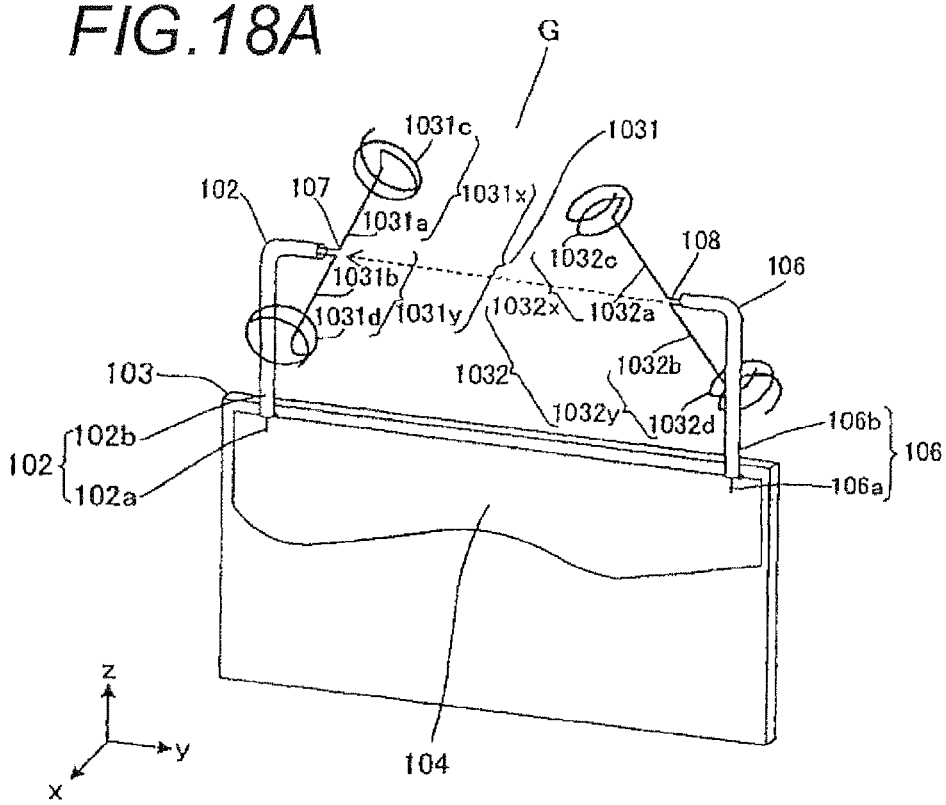
FIGS. 18A and 18B describe the effect when one dipole antenna receives a direct wave from the other dipole antenna.
Figure 18B:
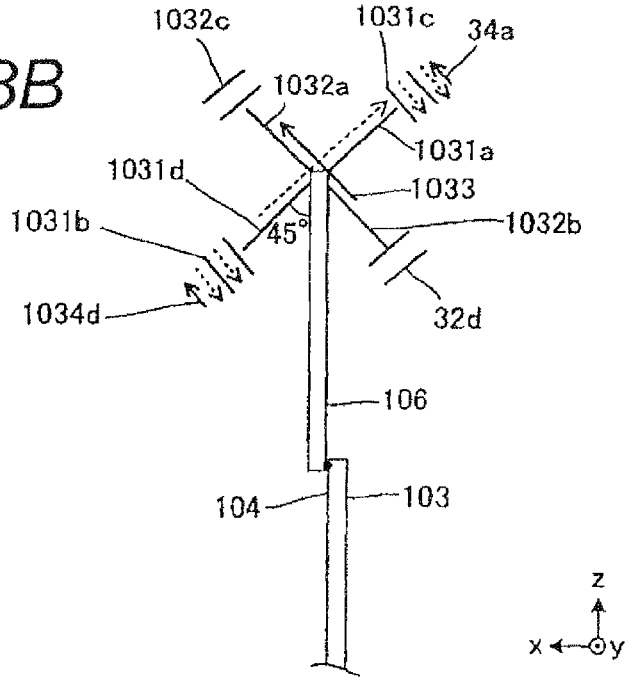

FIGS. 18A and 18B describe the effect when one dipole antenna receives a direct wave from the other dipole antenna. FIG. 18A shows the case where the first antenna 1031 receives a direct wave 1033 from the second antenna 1032 in the configuration shown in FIG. 16. Like FIG. 17, FIG. 18B is a side view when the feeding point 107 is viewed from the feeding point 108. However, FIG. 18B shows only the solid line portions of the helical parts 1031*c* and 1031*d* of the first antenna 1031 and the helical parts 1032*c* and 1032*d* of the second antenna 1032 in FIG. 17 and does not shown the dashed line portions.

In FIG. 18B, the direction of an antenna current flowing into the first antenna 1031 when a transmission signal is transmitted from the first antenna 1031 at one time is indicated by the dashed arrow, and the direction of an antenna current flowing into the first antenna 1031 when the first antenna 1031 receives the direct wave 1033 from the second antenna 1032 is indicated by the solid arrow. The directions and the magnitudes of the antenna currents change like a sine wave on each of the arrow lines with the progress of the time, but the direction of the antenna current flowing instantaneously at one time is previously assumed and the case will be discussed. The same thing can be stated if the directions and the magnitudes of the antenna currents vary.

The linear parts 1031*a* and 1031*b* of the first antenna 1031 are orthogonal to the second antenna 1032 and thus hardly receive and reflect the direct wave 1033 from the second antenna 1032. Therefore, an antenna current hardly flows into the linear parts 1031*a* and 1031*b* of the first antenna 1031.

In contrast, the helical parts 1031*c* and 1031*d* of the first antenna 1031 receive and reflect the direct wave 1033 from the second antenna 1032 mainly on the side opposed to the second antenna 1032, namely, in the solid line portions of the helical parts 1031*c* and 1031*d* of the first antenna 1031.

In this case, the helical parts 1031*c* and 1031*d* of the first antenna 1031 are configured so that the maximum diameter thereof becomes short as compared with the length of the linear parts 1032*a* and 1032*b* of the second antenna 1032. Accordingly, if the helical parts 1031*c* and 1031*d* of the first antenna 1031 receive the direct wave 1033 from the second antenna 1032, the reception region is small and thus the effect of the transmission wave from the direct wave 1033 from the second antenna 1032 can be lessened.

The length resulting from linearly expanding the antenna helical parts 1031*c* and 1031*d* becomes shorter than the length of the linear parts 1031*a* and is 1031*b* of the first antenna 1031. Accordingly, if the helical parts 1031*c* and 1031*d* of the first antenna 1031 receive the direct wave 1033 from the second antenna 1032, the reception region is small and thus the energy of flowing antenna currents 1034*a* and 1034*b* is small. Therefore, the effect of the transmission wave of the second antenna 1032 on the directivity of the transmission wave of the first antenna 1031 can be suppressed.

Similarity to that described above also applies to the case where the helical parts 1032*c* and 1032*d* of the second antenna 1032 directly receive and reflect the transmission wave from the first antenna 1031.

Thus, if the radiation elements 1031*x* and 1031*y* of the first antenna 1031 and the radiation elements 1032*x* and 1032*y* of the second antenna 1032 are provided each with a helical part, degradation of the transmission and reception characteristics caused by mutual interference can be suppressed.

(Effect of Reflected Wave)

Figure 19A:
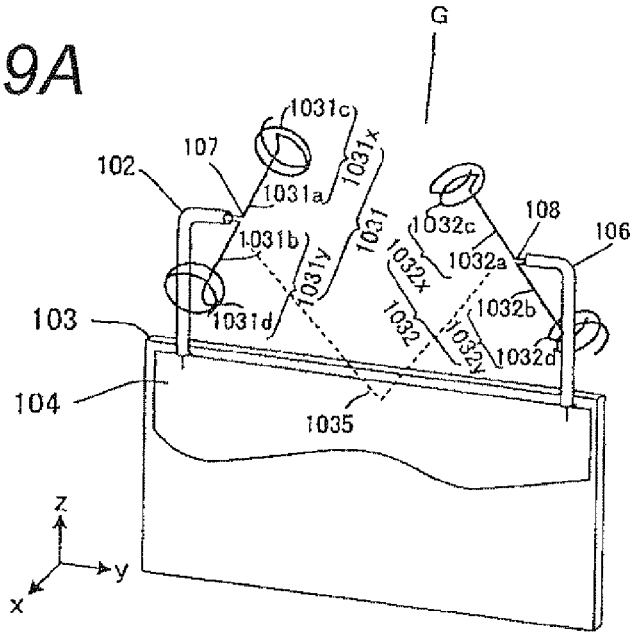
FIGS. 19A to 19C describe the effect when one dipole antenna receives a reflected wave from the other dipole antenna.
Figure 19B:
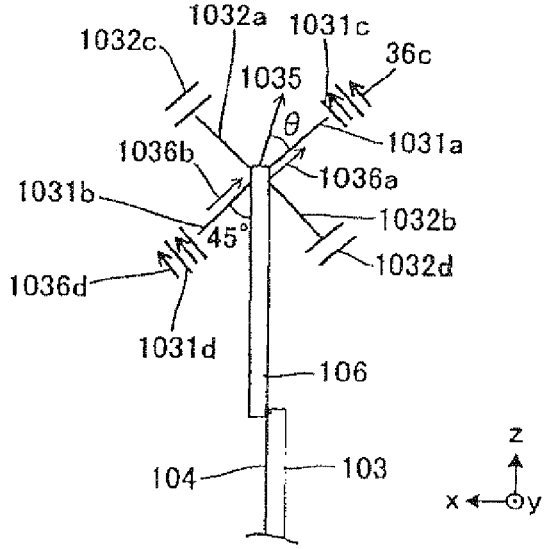
Figure 19C:
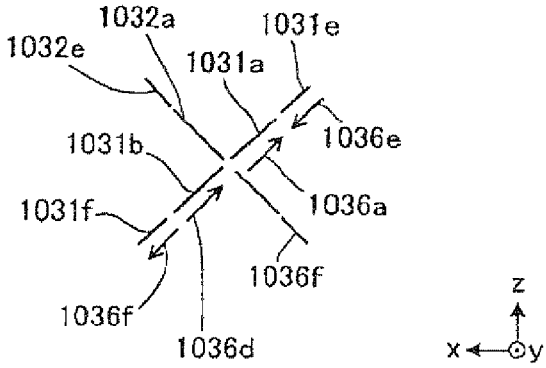

FIGS. 19A to 19C describe the effect when one dipole antenna receives a reflected wave from the other dipole antenna. FIG. 19A describes the case where a transmission wave from the second antenna 1032 is reflected, diffracted, scattered by the board 103, the feeder line 102, the first and second antennas 1031 and 1032, a cabinet not shown for covering the board 103, etc., or the like and is received and reflected by the helical parts 1031*c* and 1031*d* of the first antenna 1031. Since the board 103 has a wide metal pattern on and in the surface, it is considered that the effect of a reflected wave 1035 on the board 103 is dominant. It is considered that the extent of the effect is larger than that of the effect of the direct wave shown in FIG. 18.

Like FIG. 17, FIG. 19B is a side view when viewed from the feeding point 108. However, FIG. 19B shows the helical parts 1031*c* and 1031*d* of the first antenna 1031 and the helical parts 1032*c* and 1032*d* of the second antenna 1032 only in the solid line portions like FIG. 18B.

FIG. 19C schematically shows the directions of currents when the helical parts 1031*c* and 1031*d* of the first antenna 1031 are virtually linear shapes 1031*e* and 1031*f* and the helical parts 1032*c* and 1032*d* of the second antenna 1032 are virtually linear shapes 1032*e* and 1032*f*.

FIG. 19B shows a state in which the reflected wave 1035 transmitted from the second antenna 1032 and reflected on the board 103 is incident at an angle θ formed with the linear part 1031*a*, 1031*b* of the first antenna 1031 at one time.

The direction and the magnitude of the reflected wave 1035 change like a sine wave on the line at the angle θ formed with the linear part 1031*a*, 1031*b* of the first antenna 1031 with the progress of the time, but the direction of the instantaneous reflected wave 1035 at one time is previously assumed and the case will be discussed. The same thing can be achieved if the direction and the magnitude of the reflected wave 1035 change.

In this case, the linear parts 1031*a* and 1031*b* of the first antenna 1031 receive cos θ components 1036*a* and 1036*b* of the reflected wave 1035 and consequently an antenna current flows into the linear parts 1031*a* and 1031*b* in the directions of the arrows 1036*a* and 1036*b*.

In contrast, the helical parts 1031*c* and 1031*d* of the first antenna 1031 orthogonal to the linear parts 1031*a* and 1031*b* of the first antenna 1031 receive sine components 1036*c* and 1036*d* of the reflected wave 1035 and consequently an antenna current flows into the helical parts 1031*c* and 1031*d* in the directions of the arrows 1036*c* and 1036*d*.

As described in FIG. 16, in the first antenna 1031, the winding directions of the helical parts 1031*c* and 1031*d* are dextral (clockwise) away from the feeding point 107 on the opposite end sides of the linear parts 1031*a* and 1031*b*. Thus, antenna currents 1036*e* and 1036*f* flowing into the linear portions 1031*e* and 1031*f* provided by linearly extending the helical parts 1031*c* and 1031*d* flow in opposite directions to and in the same magnitude as the antenna currents 1036*a* and 1036*b* flowing into the linear parts 1031*a* and 1031*b* and thus they cancel each other. That is, the energy for the first antenna 1031 to receive and reflect a transmission wave from the second antenna 1032 lessens. Therefore, the effect of the transmission wave from the second antenna 1032 on the directivity of the transmission wave from the first antenna 1031 can be suppressed.

Similarity to that described above also applies to the case where the transmission wave from the first antenna 1031 is reflected, diffracted, scattered by the board 103, etc., and the wave is received and reflected by the helical parts 1032*c* and 1032*d* of the second antenna 1032.

However, the description given above holds in the θ range of 0 degrees to 90 degrees and if the range is exceeded, the directions of the antenna currents flowing into the helical parts and the linear parts of each antenna become the same.

However, in the antenna apparatus G according to Embodiment 7, it is thought that the area of the board 103 where the first antenna 1031 is supported through the feeding point 107 and the second antenna 1032 is supported through the feeding point 108 is the largest and moreover the power supply pattern and the wiring patterns are included on the surface of the board and inside the board and thus the transmission wave from each antenna is most easily reflected as compared with any other reflection portion.

As shown in FIG. 19B, each of the angle between the first antenna 1031 and the board 103 and the angle between the second antenna 1032 and the board 103 is 45 degrees and thus it is considered that the reflection wave of the component in the Z direction along the pattern face of the board 103, namely, the reflection wave with θ=45 degrees is most dominant among the reflection waves from the antennas. This is in the θ range of 0 degrees to 90 degrees and thus the operation described above is performed.

Thus, if the radiation elements 1031*x* and 1031*y* of the first antenna 1031 and the radiation elements 1032*x* and 1032*y* of the second antenna 1032 are provided with respective helical parts, degradation of the transmission and reception characteristics caused by mutual interference can be suppressed.

(Measurement Result of Isolation Characteristic)

Next, the isolation characteristics in the antenna apparatus according to Embodiment 7 and units having other configurations, particularly the isolation characteristics about the GSM system and the DECT system having close use frequencies were actually measured and compared. The configurations and the measurement results are shown with reference to FIGS. 20A to 22C. Which of the first antenna 1031 and the second antenna 1032 a transmission-reception antenna of DECT and a transmission-reception antenna of GSM are to be placed in are not determined and are as desired. That is, the first antenna 1031 may take charge of one of DECT transmission and reception and GSM transmission and reception and the second antenna 1032 may take charge of the other.

Figure 20A:
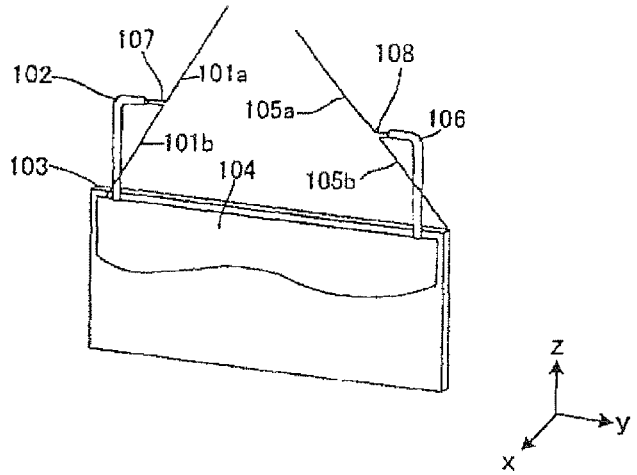
FIGS. 20A to 20C describe the measurement result of the isolation characteristic in the antenna apparatus according to Embodiment 5.
Figure 20B:
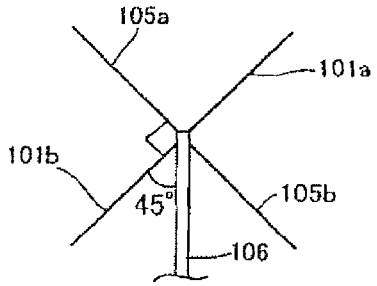
Figure 20C:
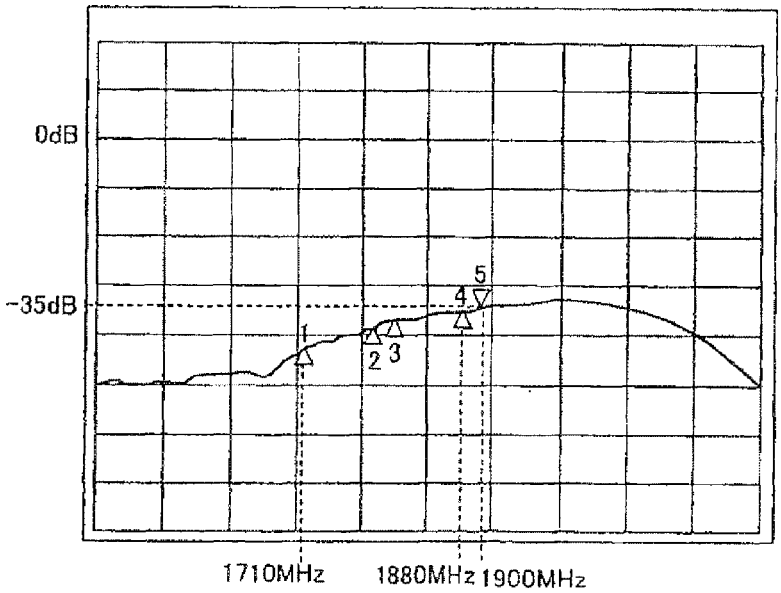

FIGS. 20A to 20C describe the measurement result of the isolation characteristic in the antenna apparatus according to Embodiment 5. FIG. 20A is a perspective view of the antenna apparatus in Embodiment 5 and is similar to FIG. 11. That is, the first dipole antenna 101 and the second dipole antenna 105 are placed orthogonal to each other. FIG. 20B is a side view of the antenna apparatus shown in FIG. 20A viewed from an X-Z plane. FIG. 20C shows the measurement result of the isolation characteristic of the antenna apparatus shown in FIG. 20A.

Figure 21A:
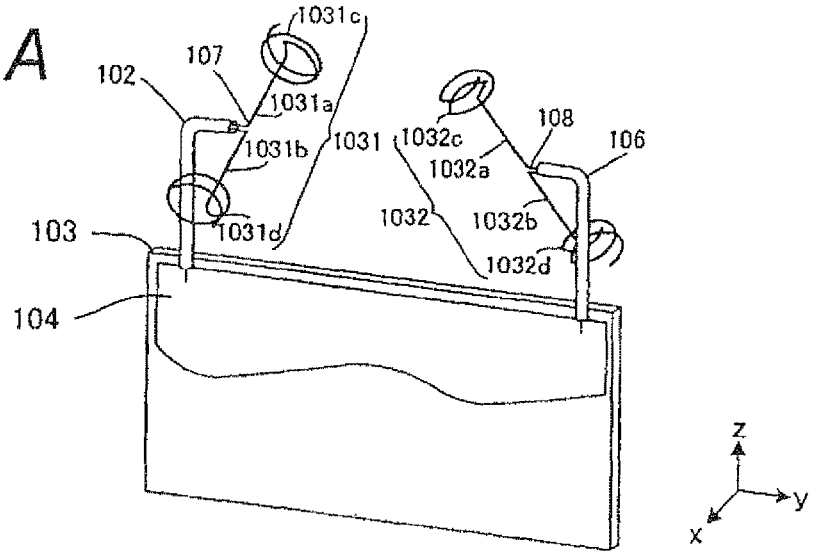
FIGS. 21A to 21C describe the measurement result of the isolation characteristic in the antenna apparatus according to Embodiment 7.
Figure 21B:
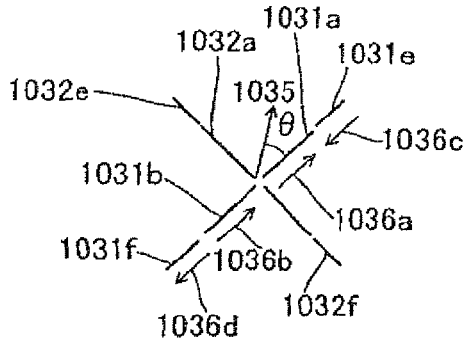
Figure 21C:
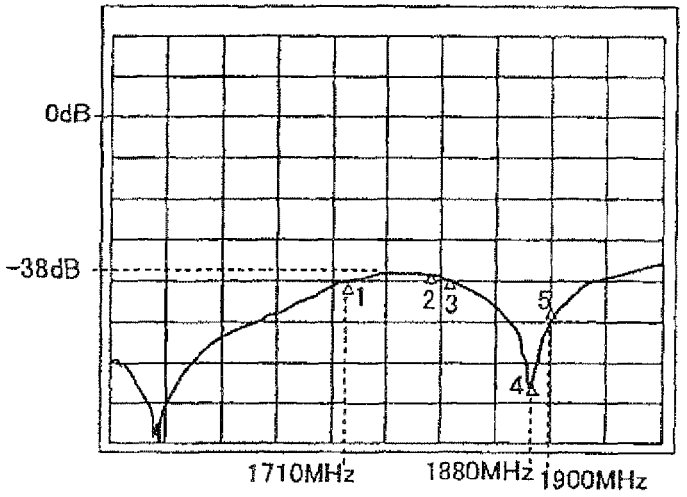

FIGS. 21A to 21C describe the measurement result of the isolation characteristic in the antenna apparatus according to Embodiment 7. FIG. 21A is a perspective view of the antenna apparatus in Embodiment 7 and is similar to FIG. 16. Like FIG. 19C, FIG. 21B schematically shows the directions of currents when the helical parts 1031*c* and 1031*d* of the first antenna 1031 and the helical parts 1032*c* and 1032*d* of the second antenna 1032 are virtually linear shapes 1031*e* and 1031*f* and linear shapes 1032*e* and 1032*f*. FIG. 21C shows the measurement result of the isolation characteristic of the antenna apparatus shown in FIG. 21A.

Figure 22A:
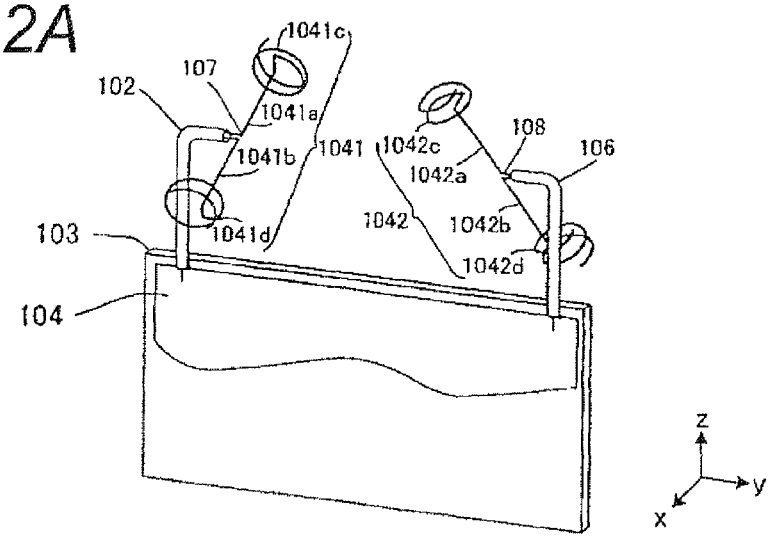
FIGS. 22A to 22C describe the measurement result of the isolation characteristic in an antenna apparatus where reception energies of linear parts and helical parts are synergistic to each other.
Figure 22B:
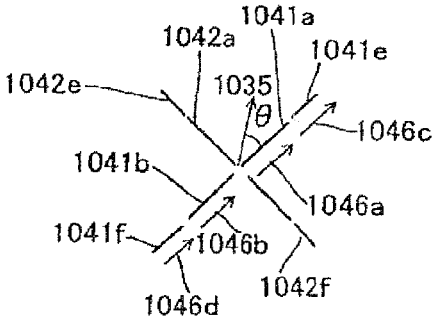
Figure 22C:
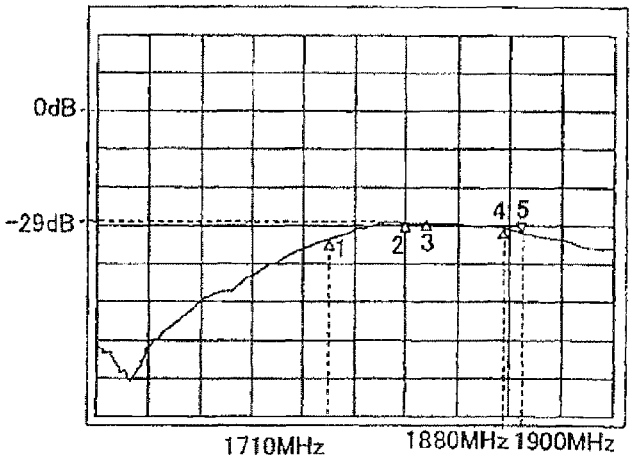

FIGS. 22A to 22C describe the measurement result of the isolation characteristic in an antenna apparatus where reception energies of linear parts and helical parts are synergistic to each other. FIG. 22A is a perspective view of the antenna apparatus where antennas are configured so that the reception energy in the helical parts and the reception energy in the linear parts are placed in a synergistic direction unlike the antenna apparatus of Embodiment 7 although each antenna has linear and helical parts similar to those in Embodiment 7.

FIG. 22B schematically shows the directions of currents when helical parts 1041*c* and 1041*d* of a first antenna 1041 and helical parts 1042*e* and 1042*d* of a second antenna 1042 are virtually linear shapes 1041*e* and 1041*f* and linear shapes 1042*e* and 1042*f* in a side view of the antenna apparatus in FIG. 22A viewed from an X-Z plane. FIG. 22C shows the measurement result of the isolation characteristic of the antenna apparatus shown in FIG. 22A.

The measurement results of the isolation characteristics in the configurations are compared seeing FIGS. 20C, 21C, and 22C. In the figures, the horizontal axis indicates frequencies and the vertical axis indicates the sensitivity of receiving a transmission wave of one antenna by the other antenna; it can be the that the lower the sensitivity, the less the interference.

The GSM band and the DECT band are close to each other as follows:

In the GSM band, a transmission wave is 1710 MHz ("Δ mark 1" shown in FIGS. 20C, 21C, and 22C) to 1785 MHz ("Δ mark 2" shown in FIGS. 20C, 21C, and 22C), and a reception wave is 1805 MHz ("Δ mark 3" shown in FIGS. 20C, 21C, and 22C) to 1880 MHz ("Δ mark 4" shown in FIGS. 20C, 21C, and 22C).

The DECT band is 1880 MHz ("Δ mark 4" shown in FIGS. 20C, 21C, and 22C) to 1900 MHz ("Δ mark 5" shown in FIGS. 20C, 21C, and 22C).

Seeing the isolation characteristic (FIG. 20C) in the antenna apparatus having the configuration wherein the first dipole antenna 101 and the second dipole antenna 105 are only placed orthogonal to each other as shown in FIG. 20A, the maximum sensitivity at 1710 MHz to 1900 MHz of the GSM and DECT bands is about −35 dB.

In contrast, seeing the isolation characteristic (FIG. 21C) in the antenna apparatus configured so that the reception energy in the helical parts 1031*c* and 1031*d* of the first antenna 1031 and the reception energy in the linear parts 1031*a* and 1031*b* cancel each other (namely, the directions of the antenna currents 1036*a* and 1036*c* become opposite to each other and the directions of the antenna currents 1036*b* and 1036*d* become opposite to each other as shown in FIG. 21B), the maximum sensitivity at 1710 MHz to 1900 MHz of the GSM and DECT bands is about −38 dB and it is seen that the isolation is improved about 3 dB as compared with that in FIG. 20C. Particularly at 1880 MHz to 1900 MHz of the DECT frequencies, the sensitivity rapidly lowers and interference received by the GSM antenna owing to the transmission wave from the DECT antenna is very small and the isolation characteristic very improves.

In contrast, seeing the isolation characteristic (FIG. 22C) in the antenna apparatus configured so that the reception energy in the helical parts 1041*c* and 1041*d* of the first antenna 1041 and the reception energy in the linear parts 1041*a* and 1041*b* are synergistic each other (namely, the directions of the antenna currents 1046*a* and 1046*c* become the same and the directions of the antenna currents 1046*b* and 1046*d* become the same, as shown in FIG. 22B), the maximum sensitivity at 1710 MHz to 1900 MHz of the GSM and DECT bands is about −29 dB and it is seen that the isolation worsens about 6 dB as compared with that in FIG. 20C.

Thus, as a result of the comparison of the isolation characteristics in FIGS. 20C, 21C, and 22C, it turned out that the antenna apparatus G according to Embodiment 7 configured so that the reception energy in the helical parts 1031*c* and 1031*d* of the first antenna 1031 and the reception energy in the linear parts 1031*a* and 1031*b* cancel each other has the excellent isolation characteristic as compared with other antenna apparatuses.

The isolation characteristic varies depending on the situation of the antenna periphery, for example, the design of a cabinet housing the antenna apparatus, etc. However, if the antenna apparatus is configured so that the reception energy in the helical parts and the reception energy in the linear parts cancel each other in each antenna as previously described with FIGS. 16 to 19C, the improvement effect of the isolation characteristic can always be expected in any case.

As described above, according to Embodiment 7, the helical directions of the helical parts are formed so that energy for the helical parts to receive a reflected wave produced as a transmission wave from the other dipole antenna is reflected on another component existing in the vicinity of a midpoint on the path in one dipole antenna and energy for the linear parts to receive the reflected wave cancel each other, so that the effect of a transmission wave of one antenna on the other antenna can be more lessened. While the application example to the antenna configuration in Embodiment 5 has been shown in Embodiment 7, it can also be applied to the antenna configuration in Embodiment 6 in a similar manner, needless to say.

(Embodiment 8)

Figure 23:
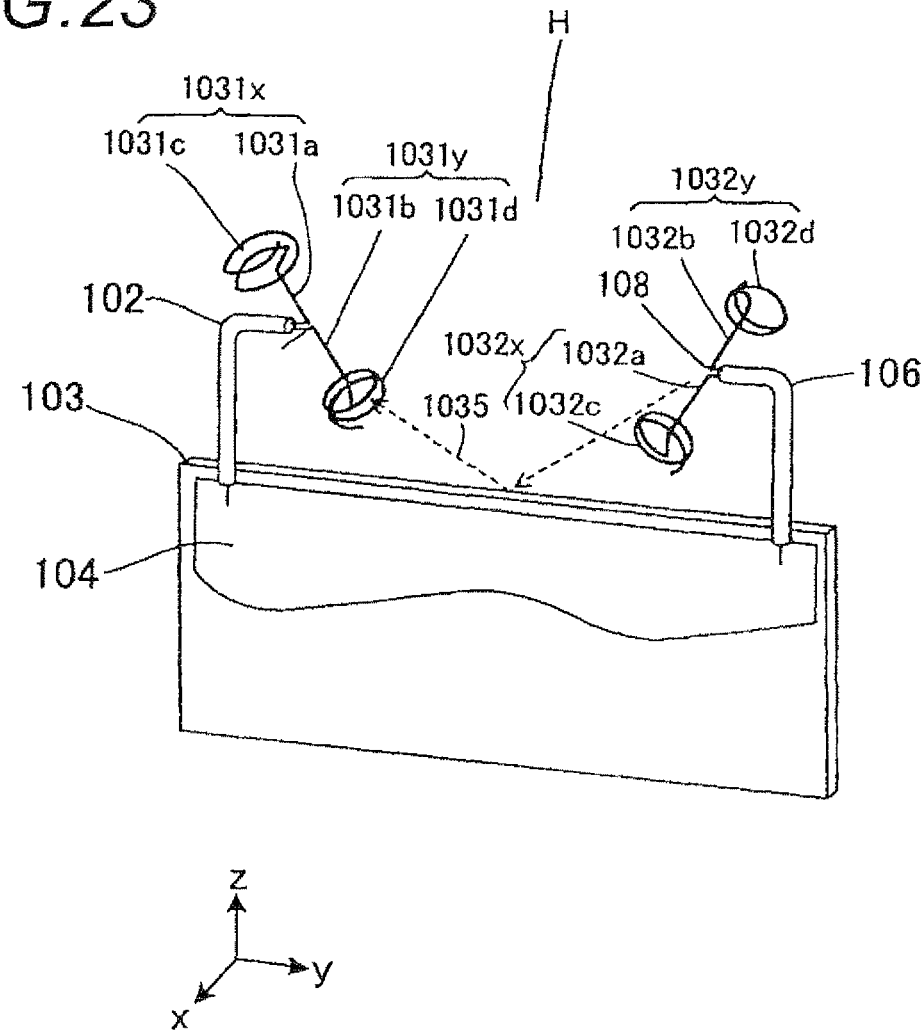
FIG. 23 is a perspective view to show the configuration of an antenna apparatus according to Embodiment 8.
Figure 24A:
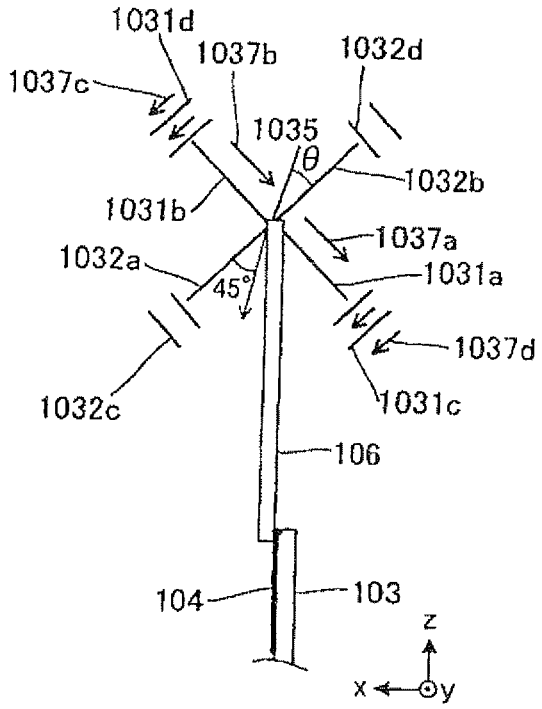
FIGS. 24A and 24B describe the placement form and the operation of two dipole antennas making up the antenna apparatus shown in FIG. 23.
Figure 24B:
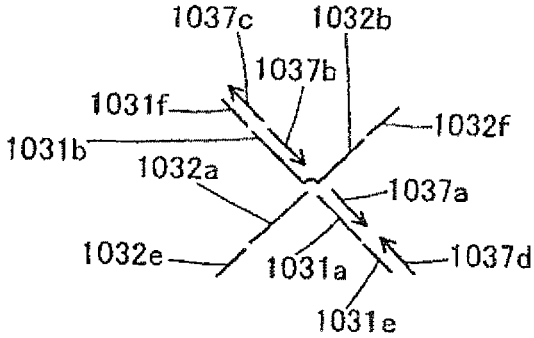

FIG. 23 is a perspective view to show the configuration of an antenna apparatus according to Embodiment 8. FIGS. 24A and 24B describe the placement form and the operation of two dipole antennas making up the antenna apparatus shown in FIG. 23. Embodiment 8 shows one modified example of Embodiment 7.

That is, the antenna connection method and the winding directions of the helical parts are not limited to those described in Embodiment 7. Even if the antenna connection method is an antenna connection method in which the antenna current directions at the transmitting time differ from those in Embodiment 7, if the winding directions of the helical parts are set so that the reception energy in the helical parts and the reception energy in the linear parts cancel each other conforming to the antenna connection method, similar advantages to those described in Embodiment 7 can be provided.

An antenna apparatus H according to Embodiment 8 shown in FIG. 23 has antenna placement provided by rotating 180 degrees the antenna placement in the antenna apparatus G according to Embodiment 7 shown in FIG. 16. FIG. 24A corresponds to FIG. 19B and FIG. 24B corresponds to FIG. 19C.

In the antenna apparatus H according to Embodiment 8, the winding directions of the helical parts can be changed from dextral to sinistral because the antenna placement is changed from that in Embodiment 7. That is, in a first antenna 1031, the winding directions of helical parts 1031*c* and 1031*d* are made sinistral (counterclockwise) away from a feeding point 107 on the opposite end sides of linear parts 1031*a* and 1031*b* so that the reception energy in the helical parts 1031*c* and 1031*d* and the reception energy in the linear parts 1031*a* and 1031*b* cancel each other. In a second antenna 1032, the winding directions of helical parts 1032*c* and 1032*d* are made sinistral (counterclockwise) away from a feeding point 108 on the opposite end sides of linear parts 1032*a* and 1032*b* so that the reception energy in the helical parts 1032*c* and 1032*d* and the reception energy in the linear parts 1032*a* and 1032*b* cancel each other.

Accordingly, the directions of the current flowing through the linear parts and the current flowing through the helical parts in each antenna become opposite to each other and the currents cancel each other, so that similar advantages to those described in Embodiment 7 can be provided.

(Embodiment 9)

Figure 25:
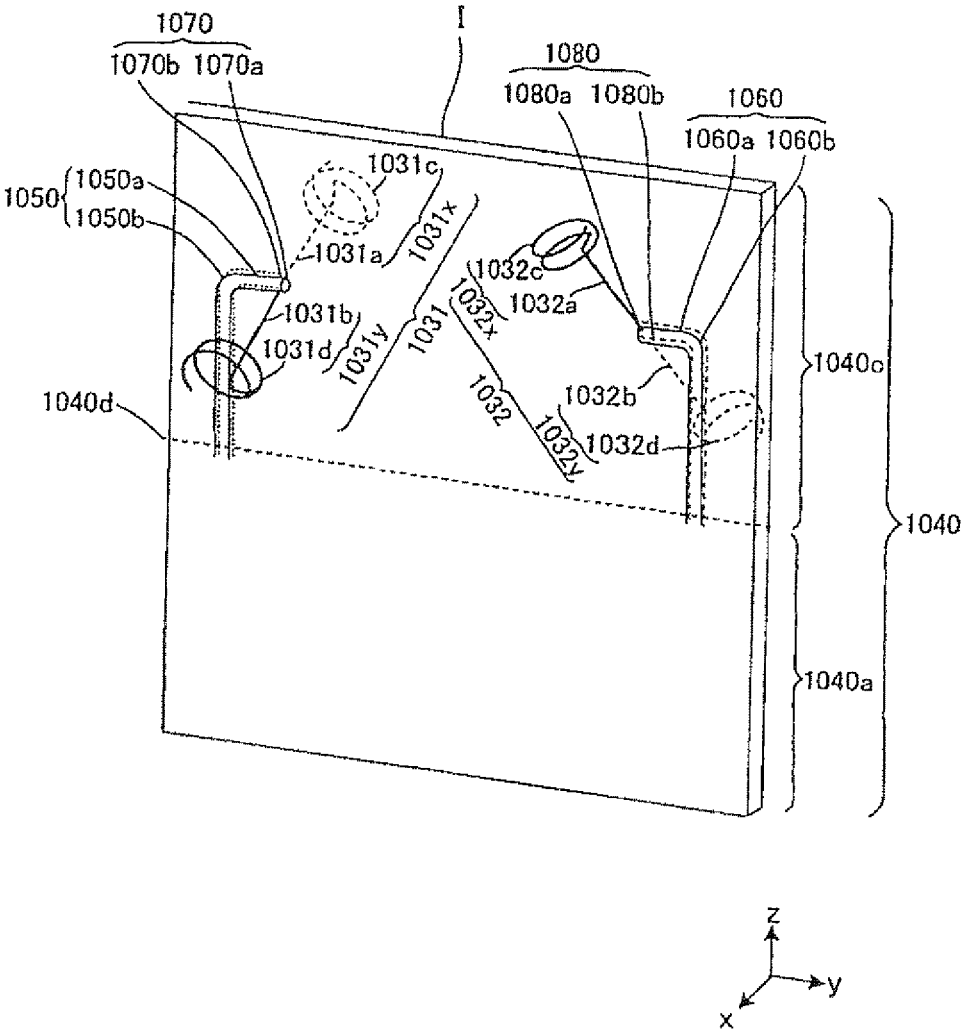
FIG. 25 is a perspective view to show the configuration of an antenna apparatus according to Embodiment 9.

FIG. 25 is a perspective view to show the configuration of an antenna apparatus according to Embodiment 9. An antenna apparatus 1 according to Embodiment 9 shown in FIG. 25 has a base material 1040 made up of a board section 1040*a* and an antenna support section 1040*c* and the antenna placement shown in Embodiment 7 is realized in the antenna support section 1040*c*.

Like the board 103, the board section 1040*a* has a conductor pattern not shown. Feeder lines 1050 and 1060 placed on the antenna support section 1040*c* side from a boundary (one side-end side of the board section 1040*a*) between the board section 1040*a* and the antenna support section 1040*c* are made up of Hot side conductor feed lines 1050*a* and 1060*a* and Cold side conductor feed lines 1050*b* and 1060*b*, and are placed on different faces of the antenna support section 1040*c*.

That is, the Hot side conductor feed line 1050*a* of the feeder line 1050 and the Cold side conductor feed line 1060*b* of the feeder line 1060 are placed on one face (back in the example shown in the figure) of the antenna support section 1040*c*, and the Cold side conductor feed line 1050*b* of the feeder line 1050 and the Hot side conductor feed line 1060*a* of the feeder line 1060 are placed on an opposite face (surface in the example shown in the figure) of the antenna support section 1040*c*.

The Hot side conductor feed lines 1050*a* and 1060*a* and the Cold side conductor feed lines 1050*b* and 1060*b* of the feeder lines 1050 and 1060 have Hot side feeding points 1070*a* and 1080*a* and Cold side feeding points 1070*b* and 1080*b* and first and second antennas 1031 and 1032 are attached thereto.

In the first antenna 1031, a minus side radiation element 1031*y* is placed on the surface of the antenna support section 1040*c* and a plus side radiation element 1031*x* is placed on the back of the antenna support section 1040*c*. In the second antenna 1032, a minus side radiation element 1032*y* is placed on the back of the antenna support section 1040*c* and a plus side radiation element 1032*x* is placed on the surface of the antenna support section 1040*c*.

In Embodiment 9, the Hot side conductor feed lines 1050*a* and 1060*a* and the Cold side conductor feed lines 1050*b* and 1060*b* are configured so as to become one body on both sides with the base material 1040 therebetween. At feeding point 1070 corresponding to the connection part of the feeder line 1050 and the first antenna 1031 and feeding point 1080 corresponding to the connection part of the feeder line 1060 and the second antenna 1032, the Hot side feeding points 1070*a* and 1080*a* of the Hot side conductor feed lines 1050*a* and 1060*a* and the Cold side feeding points 1070*b* and 1080*b* of the Cold side conductor feed lines 1050*b* and 1060*b* are configured so as to become one body on both sides with the base material 1040 therebetween; however, through hole connection is not made between the Hot side feeding point 1070*a* and the Cold side feeding point 1070*b* and is not made between the Hot side feeding point 1080*a* and the Cold side feeding point 1080*b* and they are electrically insulated by the base material 1040.

The features relating to Embodiment 9 have been described and the essential configuration of the antenna apparatus is the same as that of Embodiment 7.

That is, the antenna apparatus I according to Embodiment 9 includes the board section 1040*a* formed with a conductor pattern not shown, the first and second dipole antennas 1031 and 1032 placed on the antenna support section 1040*c* corresponding to outward extension of the board face from a side of one side-end 1040*d* of the board section 1040*a*, and the first and second feeder lines 1050 and 1060 for connecting the conductor pattern not shown in the board section 1040*a* and the feeding points 1070 and 1080 of the first and second dipole antennas 1031 and 1032.

Each of the first radiation elements 1031*x* and 1031*y* joined to the feeding point 1070 of the first dipole antenna 1031 on one end side (the left in the example shown in the figure) on the side of the one end-side 1040*d* of the board section 1040*a*, and a second radiation element 1032*x* and 1032*y* joined to the feeding point 1080 of the second dipole antenna 1032 on an opposite end side (the right in the example shown in the figure) on the side of the one side-end 1040*d* of the board section 1040*a*, are disposed in respective perpendicular planes orthogonal to a board face and the one side-end 1040*d*, and are placed facing each other so that mutual axial directions of the first and second radiation elements are orthogonal to each other, and the axis of the first radiation elements 1031*x* and 103*a y* is placed so as to be inclined at an angle larger than 0 degrees and smaller than 90 degrees with respect to a line parallel to the board face and orthogonal to the one side-end 1040*d*.

The first feeder line 1050 or the second feeder line 1060 has the Hot side conductor feed line 1050*a*, 1060*a* not connected to ground (not shown) of high-frequency circuit provided in the board section 1040*a* and the Cold side conductor feed line 1050*b*, 1060*b* connected to ground (not shown) of the high-frequency circuit provided in the board section 1040*a*.

The plus side radiation elements 1031*x* and 1032*x* are connected to the Hot side feeding points 1070*a* and 1080*a* of the Hot side conductor feed lines 1050*a* and 1060*a* and the minus side radiation elements 1031*y* and 1032*y* are connected to the Cold side feeding points 1070*b* and 1080*b* of the Cold side conductor feed lines 1050*b* and 1060*b*. The plus side radiation elements 1031*x* and 1032*x* and the minus side radiation elements 1031*y* and 1032*y* have linear parts 1031*a* and 1031*b* and 1032*a* and 1032*b* connected at one end to the feeder lines 1050 and 1060 and helical parts 1031*c* and 1031*d* and 1032*c* and 1032*d* provided in end parts not connected to the feeder line 1050 or 1060.

The helical directions of the helical parts 1031*c*, 1031*d*, 1032*c*, and 1032*d* are formed so that energy for the helical parts to receive a reflected wave produced as a transmission wave from the other dipole antenna is reflected on another component existing in the vicinity of a midpoint on the path to the dipole antenna having the linear parts 1031*a*, 1031*b*, 1032*a*, and 1032*b* and the helical parts 1031*c*, 1031*d*, 1032*c*, and 1032*d* and energy for the linear parts to receive the reflected wave cancel each other.

In Embodiment 9, more particularly, the helical parts 1031*c* and 1032*c* in the plus side radiation elements 1031*x* and 1032*x* are attached to the Hot side feeding points 1070*a* and 1080*a* provided on the antenna support section 1040*c* so as to be disposed away from the board section 1040*a*, and the helical parts 1031*d* and 1032*d* in the minus side radiation elements 1031*y* and 1032*y* are attached to the Cold side feeding points 1070*b* and 1080*b* provided on the antenna support section 1040*c* so as to be brought close to the board section 1040*a*.

In the first antenna 1031, the winding directions of the helical parts 1031*c* and 1031*d* are dextral (clockwise) in the direction starting from and away from end parts not connected to the feeding point 1070 of the linear parts 1031*a* and 1031*b* when viewed from the connection side with the feeding point 1070 of the linear parts 1031*a* and 1031*b*. In the second antenna 1032, the winding directions of the helical parts 1032*c* and 1032*d* are dextral (clockwise) in the direction starting from and away from end parts not connected to the feeding point 1080 of the linear parts 1032*a* and 1032*b* when viewed from the connection side with the feeding point 1080 of the linear parts 1032*a* and 1032*b*.

As described above, the essential configuration is similar to that described in Embodiment 7 and thus advantages similar to those described in Embodiment 7 can also be provided in Embodiment 9. While the application example of Embodiment 7 has been shown in Embodiment 9, the configuration wherein the feeder lines and the board section are provided on the base material can also be applied to Embodiments 5, 6, and 8 in a similar manner, and advantages similar to those described in Embodiments 5, 6, and 8 can be provided.

(Embodiment 10)

Figure 26:
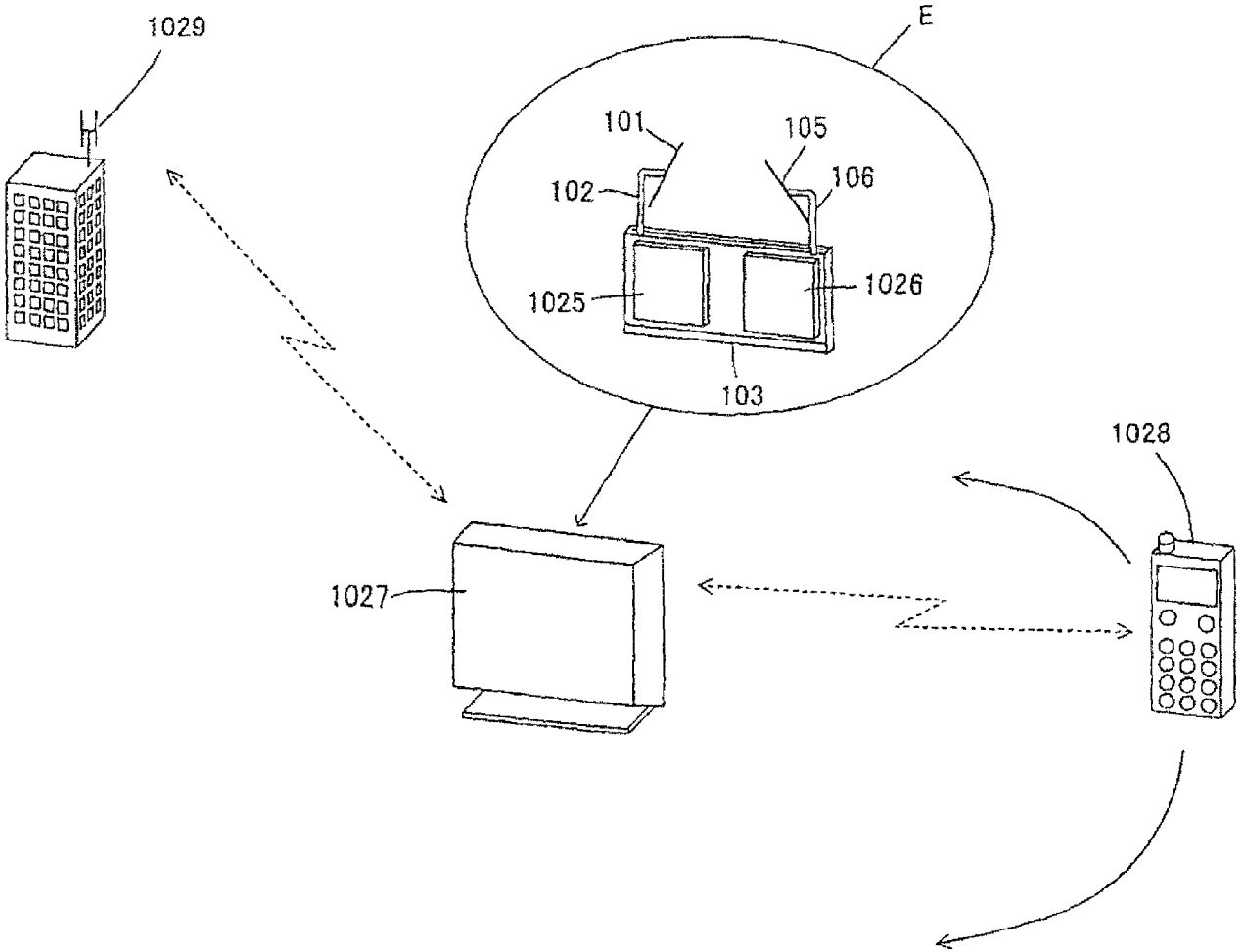
FIG. 26 is a configuration drawing of a DECT cordless telephone system as Embodiment 10 using the antenna apparatus shown in FIG. 11.

FIG. 26 is a configuration drawing of a DECT cordless telephone system as Embodiment 10 using the antenna apparatus shown in FIG. 11. In FIG. 26, an antenna apparatus E has a board 103 on which a GSM module 1025 to which a first dipole antenna 101 is connected and a DECT module 1026 to which a second dipole antenna 105 is connected are mounted. A sound signal and a control signal are transmitted and received between the GSM module 1025 and the DECT module 1026. The antenna apparatus E is stored in a DECT base unit 1027.

Reference numeral 1028 denotes a DECT cordless handset and this DECT cordless handset 1028 conducts communications with the DECT module 1026 of the DECT base unit 1027. Reference numeral 1029 denotes a GSM base station and this GSM base station 1029 conducts communications with the GSM module 1025 in the DECT base unit 1027.

The DECT base unit 1027 uses GSM as an access line and is connected to a public telephone network for originating and receiving a call with the DECT cordless handset 1028.

To use DCS1800 as GSM, it has a frequency band adjacent to that of DECT, but isolation between the two dipole antennas is provided and they do not interfere with each other as described above. Thus, construction of such wireless devices is possible.

Since a radio wave can be transmitted and received in all directions in the XY plane of the horizontal plane, the DECT cordless handset 1028 can be used all around the DECT base unit 1027, so that a cordless telephone system for providing high convenience for the user to eliminate the need for selecting the direction of the GSM base station 1029 to communicate can be provided.

While the application example of the antenna apparatus E according to Embodiment 5 has been shown in Embodiment 10, the antenna apparatus E according to Embodiment 6 and various antenna apparatuses according to Embodiments 7 to 9 can also be used in a similar mode.

While the invention has been described in detail with reference to the specific Embodiments, it will be obvious to those skilled in the art that various changes and modifications can be made without departing from the spirit and the scope of the invention.

This application is based on Japanese Patent Application No. 2008-124318 filed on May 12, 2008 and Japanese Patent Application No. 2008-161338 filed on Jun. 20, 2008, the contents of which are incorporated herein by reference.

Industrial Applicability

As described above, the antenna apparatus according to the invention is useful as an antenna apparatus that can be miniaturized without causing inference caused by antenna currents to occur if the high band of a dual band wireless system is close to the band of another wireless system in a wireless communication apparatus incorporating the dual band wireless system and another wireless system.

The antenna apparatus according to the invention is useful as an antenna apparatus which ensures antenna-to-antenna isolation of two wireless devices and can transmit and receive a signal in all directions with no null point in a horizontal plane in a communication apparatus installing two wireless devices using close frequency bands.

REFERENCE SIGNS LIST

A, B, C, D Antenna apparatus
1 Dipole antenna
1*a* First radiation element
1*b* Second radiation element
2 Feeder line (microstrip line)
2*a* Signal conductor of feeder line
2*b* Ground conductor of feeder line
3 High-frequency module (high-frequency circuit)
4*a*, 4*b* Ground conductor
5 First switch
5*a* Chip capacitor
5*b* Chip coil
6 Second switch
6*a* Chip capacitor
6*b* Chip coil
20 First switch
20*a* Chip capacitor
20*b* Chip coil
21 Second switch
21*a* Chip capacitor
21*b* Chip coil
24 Board
25 Feeder line bent at right angle
26 Board
27 GSM module
28 DECT module
29 Feeder line (microstrip line)
30 Dipole antenna
D Another antenna apparatus
E, F, G, H, I Antenna apparatus
101 First dipole antenna
101*a*, 101*b* Radiation elements making up first dipole antenna
102*a* Hot side conductor feed line
102*b* Cold side conductor feed line
103 Board
104 Ground pattern
105 Second dipole antenna
105*a*, 105*b* Radiation elements making up second dipole antenna
106 Feeder line (coaxial cable) to second dipole antenna
106*a* Hot side conductor feed line
106*b* Cold side conductor feed line
107 Feeding point of first dipole antenna
108 Feeding point of second dipole antenna
109 In-XZ-plane directivity of first dipole antenna
1010 In-XZ-plane directivity of second dipole antenna
1011 In-XY-plane directivity of first dipole antenna
1012 In-XY-plane directivity of second dipole antenna
1018, 1019 Branch conductor
1020 Notch provided in end side of ground pattern
1025 GSM module
1026 DECT module
1027 DECT base unit
1028 DECT handset
1029 GSM base station
1031 First dipole antenna (first antenna)
1031*a*, 1031*b* Linear part
1031*c*, 1031*d* Helical part

1031*e*, 1031*f* Portion provided by linearly extending helical part 1031*c*, 1031*d*
1031*x* Plus side radiation element
1031*y* Minus side radiation element
1032 Second dipole antenna (second antenna)
1032*a*, 1032*b* Linear part
1032*c*, 1032*d* Helical part
1032*e*, 1032*f* Portion provided by linearly extending helical part 1032*c*, 1032*d*
1032*x* Plus side radiation element
1032*y* Minus side radiation element
1033 Direct wave
1034*a*, 1034*d* Antenna current
1035 Reflected wave
1036*a*, 1036*b*, 1036*c*, 1036*b*, 1036*d*, 1036*e*, 1036*f* cos θ component
1040 Base material
1040*a* Board section
1040*c* Antenna support section
1040*d* One side-end side of board section
1050, 1060 Feeder line
1050*a*, 1060*a* Hot side conductor feed line
1050*b*, 1060*b* Cold side conductor feed line
1070, 1080 Feeding point
1070*a*, 1080*a* Hot side feeding point
1070*b*, 1080*b* Cold side feeding point

The invention claimed is:

1. An antenna apparatus, comprising:
a dipole antenna including a first radiation element and a second radiation element, each having a quarter wavelength of a first frequency;
a high-frequency circuit for conducting communications of a high frequency signal;
a ground portion corresponding to the high-frequency circuit;
a signal conductor which connects the dipole antenna to the high-frequency circuit and the ground portion, the signal conductor having a length where the sum total of the length of the first radiation element and the length of the signal conductor, and the sum total of the length of the second radiation element and the length of the signal conductor become a quarter wavelength of a second frequency, respectively;
a first switch for blocking passage of a signal of the first frequency and allowing passage of a signal of the second frequency; and
a second switch for allowing passage of the signal of the first frequency and blocking passage of the signal of the second frequency.

2. The antenna apparatus according to claim 1,
wherein the signal conductor includes a first conductor which connects the dipole antenna to the high-frequency circuit, and a second conductor which connects the dipole antenna to the ground portion,
wherein the first switch is connected between the first conductor and the second conductor, and
wherein the second switch is connected between the second conductor and the ground portion.

3. The antenna apparatus according to claim 1,
wherein the signal conductor includes a first conductor which connects the dipole antenna to the high-frequency circuit, and a second conductor which connects the dipole antenna to the ground portion,
wherein the first switch is connected between the first conductor and the second conductor, and
wherein the second switch is connected between the second conductor and the dipole antenna.

4. The antenna apparatus according to claim 1,
wherein the first switch is implemented as a parallel resonant circuit whose resonance frequency is set to the first frequency.

5. The antenna apparatus according to claim 1,
wherein the second switch is implemented as a parallel resonant circuit whose resonance frequency is set to the second frequency.

6. The antenna apparatus according to claim 1,
wherein the signal conductor is provided in a linear shape.

7. The antenna apparatus according to claim 1,
wherein the signal conductor is provided to be bent at a right angle.

8. The antenna apparatus according to claim 1,
wherein the signal conductor is a strip line.

9. The antenna apparatus according to claim 1,
wherein the signal conductor is a coaxial line.

10. An antenna apparatus, comprising:
a first dipole antenna;
a second dipole antenna;
a board formed with a conductor pattern, the board having a board face and one side-end intersecting with the board face;
first and second feeder lines which connect the conductor pattern on a side of the one side-end of the board to feeding points of the first and second dipole antennas, respectively;
a first radiation element joined to the feeding point of the first dipole antenna; and
a second radiation element joined to the feeding point of the second dipole antenna,
wherein the feeding points of the first and second dipole antennas are disposed on the same plane in which the board face is outwardly extended from the one side-end of the board,
wherein the first and second radiation elements are disposed in respective perpendicular planes orthogonal to both the board face and the one side-end of the board, and are placed facing each other so that mutual axial directions of the first and second radiation elements are orthogonal to each, other, and
wherein the axis of the first radiation element is placed so as to be inclined at an angle larger than 0 degrees and smaller than 90 degrees with respect to a line parallel to the board face and orthogonal to the one side-end of the board.

11. The antenna apparatus according to claim 10, wherein the angle larger than 0 degrees and smaller than 90 degrees is 45 degrees.

12. The antenna apparatus according to claim 10,
wherein either or both of a connection end part of the first feeder line to the feeding point of the first dipole antenna and a connection end part of the second feeder line to the feeding point of the second dipole antenna are disposed in parallel with the one side-end of the board.

13. The antenna apparatus according to claim 10,
wherein either or both of the first feeder line and the second feeder line are unbalanced lines, and a balanced-unbalanced transformer is connected to the feeding point of the corresponding dipole antenna in which the feeder line is the unbalanced line.

14. The antenna apparatus according to claim 10,
wherein a notch provided by deleting the conductor pattern is provided at a position where the elevation angle viewing the first dipole antenna becomes equal to the elevation angle viewing the second dipole antenna from the side of the one side-end of the board.

15. The antenna apparatus according to claim 10,
wherein either or both of the first feeder line and the second feeder line are formed of printed lines.

16. The antenna apparatus according to claim 10,
wherein the first or second feeder line includes a Cold side conductor feed line connected to ground of a high-frequency circuit provided on the board and a Hot side conductor feed line not connected to the ground,
wherein at least one of the dipole antennas includes a plus radiation element connected to the Hot side conductor feed line and a minus radiation element connected to the Cold side conductor feed line, and
wherein each of the plus radiation element and the minus radiation element has a linear part connected to the corresponding conductor feed line connected to each of the radiation elements and a helical part provided in an end part not connected to the conductor feed line.

17. The antenna apparatus according to claim 16,
wherein, in at least one of the dipole antennas, the helical direction of the helical part is formed so that energy for the helical part for receiving a reflected wave and energy for the linear part to receive the reflected wave cancel each other, the reflected wave produced as a transmission wave from the other dipole antenna is reflected on another component existing in the vicinity of a midpoint on the path to the dipole antenna having the linear part and the helical part.

18. The antenna apparatus according to claim 17,
wherein the length of the helical part when the helical part is made linear is shorter than that of the linear part.

19. The antenna apparatus according to claim 17,
wherein the maximum diameter of the helical part of one dipole antenna is shorter than the linear part of the other dipole antenna.

20. The antenna apparatus according to claim 16,
wherein the plus radiation element is attached to the board so that the helical part thereof is disposed away from the board, and the minus radiation element is attached to the board so that the helical part thereof is brought close to the board, and
wherein each of the helical parts is formed so that the winding direction of the helical part become dextral (clockwise) in the direction starting from and away from the end part side not connected to the feeder line of the linear part when viewed from the connection side with the feeder line of the linear part.

21. The antenna apparatus according to claim 20,
wherein the length of the helical part when the helical part is made linear is shorter than the length of the linear part.

22. The antenna apparatus according to claim 20,
wherein the maximum diameter of the helical part of one dipole antenna is shorter than the length of the linear part of the other dipole antenna.

23. The antenna apparatus according to claim 16,
wherein the plus radiation element is attached to the board so that the helical part thereof is brought close to the board, and the minus radiation element is attached to the board so that the helical part thereof is disposed away from the board, and
wherein each of the helical parts is formed so that the winding direction of the helical part become sinistral (counterclockwise) in the direction starting from and away from the end part side not connected to the feeder line of the linear part when viewed from the connection side with the feeder line of the linear part.

24. The antenna apparatus according to claim 23,
wherein the length of the helical part when the helical part is made linear is shorter than the length of the linear part.

25. The antenna apparatus according to claim 23,
wherein the maximum diameter of the helical part of one dipole antenna is shorter than the length of the linear part of the other dipole antenna.

* * * * *